US008950233B2

(12) United States Patent
Pyper et al.

(10) Patent No.: US 8,950,233 B2
(45) Date of Patent: Feb. 10, 2015

(54) SHOULDER PILOT ASSEMBLY WITH SELF-CONTAINED STRIPPER AND METHOD FOR METAL FORMING DIES

(71) Applicant: Standard Lifters, Inc., Grand Rapids, MI (US)

(72) Inventors: Joel T. Pyper, Grand Rapids, MI (US); Scott M. Breen, Marne, MI (US)

(73) Assignee: Standard Lifters, Inc., Grand Rapids, MI (US)

( * ) Notice: Subject to any disclaimer, the term of this patent is extended or adjusted under 35 U.S.C. 154(b) by 65 days.

(21) Appl. No.: 13/904,699

(22) Filed: May 29, 2013

(65) Prior Publication Data

US 2014/0144202 A1 May 29, 2014

Related U.S. Application Data

(60) Provisional application No. 61/652,360, filed on May 29, 2012.

(51) Int. Cl.

| | |
|---|---|
| ***B21J 13/10*** | (2006.01) |
| ***B21D 37/08*** | (2006.01) |
| ***B21D 43/00*** | (2006.01) |

(52) U.S. Cl.

CPC ..... *B21D 37/08* (2013.01); *B21D 43/003* (2013.01)

USPC ..... 72/420; 72/344; 72/346; 72/404

(58) Field of Classification Search

CPC ..... B21D 37/08; B21D 37/00; B21D 37/01; B21D 37/10; B21D 37/12; B21D 5/00; B21D 5/01; B21D 35/00; B21D 43/00; B21D 43/04; B21D 43/05; B21D 45/003; B21D 45/006; B21D 45/00; B21D 45/02; B21D 45/04; B21D 45/06; B21D 45/065; B21D 45/08; B21D 45/10

USPC ..... 72/420, 404, 426, 427, 446, 447, 448, 72/405.01, 361, 328, 344, 421, 428, 72/405.07; 76/107.1; 100/218; 29/434, 29/436, 450, 451, 456, 525.01, 525.03, 29/525.11

See application file for complete search history.

(56) References Cited

U.S. PATENT DOCUMENTS

| | | | | |
|---|---|---|---|---|
| 2,168,377 | A * | 8/1939 | Wales | 83/140 |
| 3,335,627 | A * | 8/1967 | Smelts | 83/140 |

(Continued)

FOREIGN PATENT DOCUMENTS

| | | |
|---|---|---|
| JP | 56084130 | 9/1981 |
| JP | 56122634 | 9/1981 |

(Continued)

OTHER PUBLICATIONS

Standard Lifters Inc , "Pilot Assembly," sales brochure, publication date Oct. 2011, 15 pages total, Grand Rapids, Michigan, USA.

(Continued)

*Primary Examiner* — Shelley Self
*Assistant Examiner* — Gregory Swiatocha
(74) *Attorney, Agent, or Firm* — Price Heneveld LLP

(57) ABSTRACT

A pilot assembly with a self-contained stripper and method for metal forming dies has a cylindrical pilot with internally mounted reciprocating ejector pins with outer ends that protrude through holes in the body of the pilot to strip stock from the pilot. The pilot assembly is secured to the die by a window mount such that one or more surfaces of the pilot abut surfaces on the window mount and die to secure the pilot to the die and window mount when the window mount is secured, via a fastener, to the die. A spring within the pilot assembly contacts an end of the ejector pins to force the pins to reciprocate when the dies are pulled apart. The assembly can be made without the locating pilot surface to provide a stripper assembly for stripping the stock from the associated die.

59 Claims, 7 Drawing Sheets

(56) References Cited

U.S. PATENT DOCUMENTS

| | | | | |
|---|---|---|---|---|
| 3,998,369 | A * | 12/1976 | Grosjean et al. | 226/58 |
| 4,342,214 | A | 8/1982 | Neuendorf | |
| 4,424,639 | A * | 1/1984 | Richardson | 43/18.1 R |
| 4,644,836 | A | 2/1987 | Wepner | |
| 4,916,931 | A | 4/1990 | Kaeseler | |
| 5,860,315 | A | 1/1999 | Sawdon | |
| 2009/0044671 | A1 * | 2/2009 | Greenleaf | 83/133 |

FOREIGN PATENT DOCUMENTS

| | | |
|---|---|---|
| JP | 57100825 | 6/1982 |
| JP | 06142788 | 5/1994 |
| KR | 1020010069897 | 7/2001 |
| KR | 1020060104028 | 10/2006 |
| KR | 100766072 | 10/2007 |

OTHER PUBLICATIONS

Standard Lifters Inc., "Pilot Sleeve," sales brochure, publication date Jan. 2012, 18 pages total, Grand Rapids, Michigan, USA.

Fibro Inc., "Pilot Units to Daimler Standard," catalog, p. E72, publication date unknown, 1 page total, Rockford, Illinois, USA.

Dayton Progress Corporation, "Regular Pilots," catalog, pp. 9, 11 and 13, publication date unknown, 3 pages total, Dayton, Ohio, USA.

Ajacs Die Sales Corporation, "Pilot Retainer," sales brochure, publication date unknown, 2 pages total, Grand Rapids, Michigan, USA.

Misumi Corporation, "Pilot Punches," catalog, pp. 202, 220, 228, 234, 242, 946 and 948, publication date unknown, 7 pages total, Schaumburg, Illinois, USA.

Modern Die Systems Inc., "Die Accessories," sales brochure, publication date unknown, 1 page total, Ellwood, Indiana, USA.

* cited by examiner

SHOULDER PILOT ASSEMBLY WITH SELF-CONTAINED STRIPPER AND METHOD FOR METAL FORMING DIES

CROSS REFERENCE TO RELATED APPLICATIONS AND CLAIM TO PRIORITY

The present application is related to commonly assigned, co-pending U.S. provisional patent application Ser. No. 61/652,360, filed May 29, 2012, entitled SHOULDER PILOT ASSEMBLY AND METHOD FOR METAL FORMING DIES AND THE LIKE, which is incorporated herein by reference, and claims priority thereto under 35 U.S.C. §119.

BACKGROUND OF THE INVENTION

The present invention relates to metal forming dies and the like, and in particular to a shoulder pilot assembly with self-contained stripper and associated method.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming processes have typically been individually designed, one of a kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, pilots, etc. are also custom designed, and installed in the die set. Current die making processes require carefully machined, precision holes and recesses in the die set for mounting the individual components, such that the same are quite labor intensive, and require substantial lead time to make, test and set up in a stamping press. Consequently, such metal forming dies are very expensive to design, manufacture, and repair or modify.

Pilot assemblies, such as that disclosed in U.S. Pat. No. 4,342,214, are used for locating a work piece in successive forming stages of a machine, such as a punch press, where the work piece is progressively moved through the forming stages of the machine. The pilot assembly typically includes a pilot pin mounted to a movable die member of the machine for guiding entry into a previously formed hole in a work piece or in a companion die member as the die members are moved toward each other, the pin being axially retractable in its mounting in the event that it strikes an obstruction. The retraction movement of the pin may be controlled by a spring or a hydraulic mechanism which includes a hydraulic chamber formed behind the pin into which the pin moves to displace a hydraulic fluid therefrom.

FIGS. 9-14 illustrate several well-known prior art metal forming dies and associated pilot mechanisms, which further represent the background of the present invention. For example, FIG. 9 illustrates one half of a die set 100, which includes a first die member 101 having a plurality of longitudinally spaced apart work stations 102 at which various bending, forming, cut-off and/or punching operations are performed on an elongate strip of metal stock 103. As best illustrated in FIG. 10, the prior art pilot mechanism 104 for the illustrated die set 100 includes a pierce tool punch 105 located at an upstream portion of stock strip 103, which, in the illustrated example, forms a vertically oriented through hole 106 in the stock strip 103 at regularly spaced apart intervals along the stock strip. The through holes or pilot holes 106 are selectively engaged by a series of pilot pins 107 positioned on at least selected ones of the die work stations 102, which serve to precisely locate the stock strip 103 in the work stations, and retain the same in place during the metal forming stroke of the die tools. After each metal forming stroke of the die tools, the pilot pins 107 are retracted out of their associated pilot holes 106 in the stock strip 103, and the stock strip 103 is then shifted longitudinally to the next adjacent work station 102, until the metal part has been completely formed and cut off of the stock strip. When the pilot pins 107 are retracted out of the pilot holes 106 in the stock strip 103, the stock strip tends to stick on one or more of the pilot pins, thereby requiring some type of stripper mechanism to separate them, such that the stock strip can be quickly and sequentially advanced longitudinally through the various die stations.

FIG. 11 illustrates another known prior art pilot assembly that includes a rectangularly shaped block or base 111 that is mounted in a blind hole pocket 112 in an associated upper die member 113. The base block 111 includes a central aperture 114 in which a pilot pin 115 is retained, and two laterally offset reaction apertures 116 in which a pair of stripper assemblies are received and retained. A female punch tool 117 is positioned in the lower die member 122, and closely receives the pilot pin 115 to precisely locate the stock strip 103 in the associated work station. Each of the stripper assemblies comprises a plunger shaped rod 118 having an outer end 119 protruding outwardly from base block 111 toward the stock strip 103, and an inner end 120 with a coil spring 121 received thereover which resiliently urges the rods 118 outwardly on opposite sides of pilot pin 115, and serve to strip the stock strip 103 from the exterior surface of the pilot pin 115 as the pilot pin and associated upper die member 113 are raised to a diverged condition relative to the lower die member 122.

FIG. 12 illustrates yet another known prior art pilot assembly, which includes an enlarged, flat mounting plate 126 which attaches to the upper surface 127 of the upper die member 113 using a pair of cap head screws 128 having threaded shanks 129 that are anchored in the upper die member 113. The upper die member 113 includes a central aperture 114 in which a pilot pin 115 is received and retained, along with a pair of reaction apertures 116 disposed on opposite sides of pilot pin 115, each of which receives and retains therein a plunger shaped rod 118. The outer ends 119 of the rods 118 protrude outwardly from the lower surface of upper die member 113, while the inner ends 120 of rods 118 have coil springs 121 received thereon which resiliently urge rods 118 outwardly, such that the outer ends 119 of rods 118 serve to strip the stock strip 103 away from the exterior surface of the pilot pin 115, and thereby permit the stock strip 103 to be shifted longitudinally into the next adjacent work station.

FIGS. 13 and 14 illustrate yet another known prior art pilot assembly which includes a rectangular shaped block or base 111 that is mounted on to the lower surface 133 of the upper die member 113 using fasteners 134. In addition, dowels 135 may be used to help locate and secure the base block 111 in dowel holes 136 in the upper die member 113 and or dowel holes 137 in the base block 111. The base block 111 includes a central aperture 114 in which a pilot pin 115 is retained, and two laterally offset reaction apertures 116 in which a pair of stripper assemblies are received and retained. A female punch tool 117 is positioned in the lower die member 122, and closely received the pilot pin 115 to precisely locate stock strip 103 in the associates work station. Each of the stripper assemblies comprises a plunger shaped rod 118 having an outer end 119 protruding outwardly from base block 111 toward the stock strip 103, and an inner end 120 with a coil spring 121 received there over which resiliently urges the rods 118 outwardly on opposite sides of the pilot pin 115 and serve to strip the stock strip 103 from the exterior surface of the pilot pin 115 as the pilot pin and associated upper die member 113 are raised to a diverged condition relative to the lower die member 122.

Large manufacturers of formed metal parts, such as those which supply parts to automobile companies and the like, have an extensive inventory of metal forming dies and related metal handling machinery. Through the years, such companies have standardized on several different styles and sizes of pilot punches and associated pins for use with their various dies, so as to maximize efficiencies when combining various tooling for a specific project. Similarly, the metal forming die industry generally has adopted such standard pilot punch and pin sizes and shapes to minimize the effort and expense of making, installing and maintaining the dies and related metal handling equipment. When a new die is designed and fabricated by a tool and die maker, the customer will often specify that the die maker use a specific shape and size of pilot punching pin, which is often one of several styles that are standard or non-custom, and are commercially readily available. Sometimes, the customer will actually provide to the die maker the pilot punch and pilot pins that it desires to be incorporated into a specific progressive metal forming die, or portion thereof.

While such prior pilot assemblies have proven generally successful, they are rather expensive and time consuming to construct and install in an associated die set, such that further improvements and enhancements to the same, as well as metal forming dies generally, would be clearly advantageous, and are disclosed herein.

SUMMARY OF THE INVENTION

One aspect of the present invention is a multi-station progressive metal forming die having at least two mutually converging and diverging die members between which an elongated stock strip is shifted longitudinally to form parts from the stock strip, along with an improved modular pilot assembly with self-contained stripper. The pilot assembly includes a generally cylindrically shaped pilot configured for operable support on one of the die members. The pilot has an outer end portion oriented toward the stock strip, an oppositely disposed inner end portion oriented away from the stock strip, and a medial portion disposed axially between the outer and inner end portions. The medial portion has an outer collar portion with an outer end surface oriented toward the stock strip with a generally cylindrical first sidewall with a first outside diameter. The medial portion also has an inner collar portion with an inner end surface oriented away from the stock strip with a generally cylindrical second sidewall with a second outside diameter. The second outside diameter is greater that the first outside diameter of the first sidewall of the outer collar portion to define an annularly shaped, radially oriented shoulder therebetween for securing the pilot in an associated pilot mounting aperture in the one die member. The medial portion also has at least one axially oriented ejector pin aperture which extends through the outer end surface and opens generally to the inner end surface. The outer end portion has a generally tapered nose protruding outwardly from the outer end surface of the outer collar portion, with a circularly shaped innermost portion disposed adjacent the outer end surface of said outer collar portion. The outer end portion is configured for close reception in a pilot hole in the stock strip. A generally conically shaped outermost portion is configured to engage the pilot hole in the stock strip and guide the same to a predetermined position in an associated die forming station. The inner end portion has a generally cylindrically shaped spring retainer rod protruding inwardly from the inner end surface of the inner collar portion, with an inner end portion oriented away from the stock strip and an outer sidewall with an outside diameter that is less than the second outside diameter of the second sidewall of the inner collar portion. A spring member having a generally hollow interior is received onto and over the spring retainer rod. The spring member has an outer end oriented toward the stock strip, and an opposite inner end oriented away from the stock strip, positioned adjacent to the inner end surface of the spring retainer rod. At least one rigid ejector pin is slidingly received and retained in the ejector pin aperture in the medial portion of the pilot. The ejector pin has an outer end that protrudes outwardly from the outer end surface of the outer collar portion of the medial portion when urged to an extended condition to contact the stock strip and strip the same away from the outer end portion of the pilot. The ejector retracts toward the medial portion of the pilot when urged to a retracted condition. The ejector pin has an inner end that operably engages the outer end of the spring member and is thereby biased outwardly by the spring member toward the extended condition. A retainer operably connects the inner end portion of the spring retainer rod with the inner end of the spring member in a pre-tensed condition to define a fully assembled condition wherein said ejector pin is biased toward said extended condition. A generally plate shaped window mount is used to operably support the pilot in the fully assembled pilot condition in the pilot mounting aperture in the one die member to define an installed condition. The window mount has a marginal portion with at least one fastener aperture extending laterally therethrough. A fastener is positioned in at least one of the fastener apertures of the window mount. Each fastener has a threaded shank portion configured for anchoring in the one die member to securely, yet detachably retain said window mount on the one die member. The window mount has a central portion with a through mounting aperture having an outer pocket portion oriented toward the stock strip to closely receive therein the outer collar portion of the pilot in the installed condition. The window mount also has an inner pocket portion oriented away from the stock strip to closely receive therein the inner collar portion of the pilot in the installed condition. The window mount has an annularly shaped, radially oriented support ledge which abuttingly engages the shoulder on the pilot in the installed condition to securely locate the pilot in a precisely centered orientation in the pilot mounting aperture in the one die member. The ejector pin automatically reciprocates between the retracted and extended conditions relative to the pilot during operation of the metal forming die to insure that the stock strip is consistently stripped away from the outer end portion of the pilot.

Yet another aspect of the present invention is a modular pilot assembly with self-contained stripper for multi-station progressive metal forming dies having at least two mutually converging and diverging die members between which an elongate stock strip is shifted longitudinally to form parts from the stock strip. The pilot assembly includes a generally cylindrically shaped pilot configured for operable support on one of the die members. The pilot has an outer end portion oriented toward the stock strip, an oppositely disposed inner end portion oriented away from the stock strip, and a medial portion disposed axially between the outer and inner end portions. The medial portion has an outer collar portion with an outer end surface oriented toward the stock strip with a generally cylindrical first sidewall with a first outside diameter. The medial portion also has an inner collar portion with an inner end surface oriented away from the stock strip with a generally cylindrical second sidewall with a second outside diameter. The second outside diameter is greater that the first outside diameter of the first sidewall of the outer collar portion to define an annularly shaped, radially oriented shoulder therebetween for securing the pilot in an associated pilot mounting aperture in the one die member. The medial portion also has at least one axially oriented ejector pin aperture which extends through the outer end surface and opens generally to the inner end surface. The outer end portion has a generally tapered nose protruding outwardly from the outer end surface of the outer collar portion, with a circularly shaped innermost portion disposed adjacent the outer end surface of said outer collar portion. The outer end portion is configured for close reception in a pilot hole in the stock strip. A generally conically shaped outermost portion is configured to engage the pilot hole in the stock strip and guide the same to a predetermined position in an associated die forming station. The inner end portion has a generally cylindrically shaped spring retainer rod protruding inwardly from the inner end surface of the inner collar portion, with an inner end portion oriented away from the stock strip and an outer sidewall with an outside diameter that is less than the second outside diameter of the second sidewall of the inner collar portion. A spring member having a generally hollow interior is received onto and over the spring retainer rod. The spring member has an outer end oriented toward the stock strip, and an opposite inner end oriented away from the stock strip, positioned adjacent to the inner end surface of the spring retainer rod. At least one rigid ejector pin is slidingly received and retained in the ejector pin aperture in the medial portion of the pilot. The ejector pin has an outer end that protrudes outwardly from the outer end surface of the outer collar portion of the medial portion when urged to an extended condition to contact the stock strip and strip the same away from the outer end portion of the pilot. The ejector retracts toward the medial portion of the pilot when urged to a retracted condition. The ejector pin has an inner end that operably engages the outer end of the spring member and is thereby biased outwardly by the spring member toward the extended condition. A retainer operably connects the inner end portion of the spring retainer rod with the inner end of the spring member in a pre-tensed condition to define a fully assembled condition wherein the ejector pin is biased toward said extended condition. A generally plate shaped window mount is used to operably support the pilot in the fully assembled pilot condition in the pilot mounting aperture in the one die member to define an installed condition. The window mount has a marginal portion with at least one fastener aperture extending laterally therethrough. A fastener is positioned in at least one of the fastener apertures of the window mount. Each fastener has a threaded shank portion configured for anchoring in the one die member to securely, yet detachably retain said window mount on the one die member. The window mount has a central portion with a through mounting aperture having an outer pocket portion oriented toward the stock strip to closely receive therein the outer collar portion of the pilot in the installed condition. The window mount also has an inner pocket portion oriented away from the stock strip to closely receive therein the inner collar portion of the pilot in the installed condition. The window mount has an annularly shaped, radially oriented support ledge which abuttingly engages the shoulder on the pilot in the installed condition to securely locate the pilot in a precisely centered orientation in the pilot mounting aperture in the one die member. The ejector pin automatically reciprocates between the retracted and extended conditions relative to the pilot during operation of the metal forming die to insure that the stock strip is consistently stripped away from the outer end portion of the pilot.

Yet another aspect of the present invention is a modular stripper assembly with self-contained strippers for multi-station progressive metal forming dies having at least two mutually converging and diverging die members between through which an elongate stock strip is shifted longitudinally to form parts from the stock strip. The stripper assembly includes a generally cylindrically shaped housing configured for operable support on one of the die members. The housing has an outer end portion oriented toward the stock strip and an oppositely disposed inner end portion oriented away from the stock strip. The outer end portion of the housing has an outer collar portion with an outer end surface oriented toward the stock strip and a generally cylindrical first sidewall with a first outside diameter. The outer end portion also has an inner collar portion with an inner end surface oriented away from the stock strip and a generally cylindrical second sidewall with a second outside diameter which is greater that the first outside diameter of the first sidewall of the outer collar portion. The inner and outer collars define an annularly shaped, radially oriented shoulder therebetween for securing the stripper assembly in an associated housing mounting aperture in the one die member. At least one axially oriented ejector pin aperture extends through the outer end surface and opens generally to the inner end surface of the outer end portion. The inner end portion has a generally cylindrically shaped spring retainer rod protruding inwardly from the inner end surface of the inner collar portion of the outer end portion. The inner end portion is oriented away from the stock strip. The inner end portion has an outer sidewall with an outside diameter that is less than the second outside diameter of the second sidewall of the inner collar portion of the outer end portion of the housing. A spring member having a generally hollow interior is received onto and over the spring retainer rod. The spring member has an outer end oriented toward the stock strip, and an opposite inner end oriented away from the stock strip, positioned adjacent to the inner end surface of the spring retainer rod. At least one rigid ejector pin is slidingly received and retained in the ejector pin aperture in the outer end portion of the housing. The ejector pin has an outer end that protrudes outwardly from the outer end surface of the outer collar portion of the outer end portion when urged to an extended condition to contact the stock strip and strip the same away from the die. The ejector pin retracts toward the outer end portion of the housing when urged to a retracted position. The ejector pin also has an inner end that operably engages the outer end of the spring member and is thereby biased outwardly by the spring member toward the extended condition. A retainer operably connects the inner end portion of the spring retainer rod with the inner end of the spring member in a pre-tensed condition to define a fully assembled condition wherein the ejector pin is biased toward the extended condition. A generally plate shaped window mount operably supports the housing in the fully assembled condition in the housing mounting aperture in the one die member to define an installed condition. The window mount has a marginal portion with at least one fastener aperture extending laterally therethrough. At least one fastener is positioned in the fastener aperture of the window mount. The fastener has a threaded shank portion configured for anchoring in the one die member to securely, yet detachably retain the window mount on the one die member. A central portion of the window mount has a through mounting aperture with an outer pocket portion oriented toward the stock strip to closely receive therein the outer collar portion of the housing in the installed condition. An inner pocket portion oriented away from the stock strip to closely receive therein the inner collar portion of the housing in the installed condition. The window mount also has an annularly shaped, radially oriented support ledge disposed therebetween which abuttingly engages the shoulder on the housing in the installed condition to securely locate the housing in a precisely centered orientation in the housing mounting aperture in the one die member, whereby the ejector pin automatically reciprocates between the retracted and extended conditions relative to the housing during operation of the metal forming die to insure that the stock strip is consistently stripped away from the one die member.

Yet another aspect of the present invention is a method for making a multi-station progressive metal forming die having at least two mutually converging and diverging die members between which an elongate stock strip is shifted longitudinally to form parts from the stock strip, with the improvement of at least one modular pilot with self-contained stripper for precisely locating the stock strip in the die stations. The method includes forming a generally cylindrically shaped pilot for operable support on one of the die members with an outer end portion oriented toward the stock strip, an oppositely disposed inner end portion oriented away from the stock strip, and a medial portion disposed axially between the outer and inner end portions. The method includes forming the medial portion with an outer collar portion having an outer end surface oriented toward the stock strip and a generally cylindrical first sidewall with a first outside diameter, an inner collar portion having an inner end surface oriented away from the stock strip and a generally cylindrical second sidewall with a second outside diameter which is greater that the first outside diameter of the first sidewall of the outer collar portion to define an annularly shaped, radially oriented shoulder therebetween for securing the pilot in an associated pilot mounting aperture in the one die member. The method includes forming at least one axially oriented ejector pin aperture that extends through the outer end surface and opens generally to the inner end surface of the medial portion. The method also includes forming the outer end portion with a generally tapered nose protruding outwardly from the outer end surface of the outer collar portion, with a circularly shaped innermost portion disposed, adjacent the outer end surface of the outer collar portion configured for close reception in a pilot hole in the stock strip. The method further includes forming a generally conically shaped outermost portion of the outer end portion to engage the pilot hole in the stock strip and guide the same to a predetermined position in an associated die forming station. The method also includes forming the inner end portion with a generally cylindrically shaped spring retainer rod protruding inwardly from the inner end surface of the inner collar portion, with an inner end surface oriented away from the stock strip and an outer sidewall with an outside diameter that is less than the second outside diameter of the second sidewall of the inner collar portion. The method further includes forming at least one rigid ejector pin with an inner end, and an outer end configured to protrude outwardly from the outer end surface of the outer collar portion of the medial portion when urged to an extended condition to contact the stock strip and to retract inwardly toward the medial portion of the pilot when urged to a retracted position. The method includes inserting the ejector pin into the ejector pin aperture in the medial portion of the pilot, such that the ejector pin is slidingly received and retained in the ejector pin aperture for longitudinal reciprocation between the extended and retracted positions. The method also includes selecting a spring member with a generally hollow interior, an outer end oriented toward the stock strip, and an opposite inner end oriented away from the stock strip. The method includes positioning the hollow interior of the spring member onto and over the spring retainer rod on the inner end portion of the pilot, with the outer end of the spring member abutting the inner end of the ejector pin. The method further includes operably connecting the inner end of the spring member with the spring retainer rod adjacent the inner end surface thereof in a pre-tensed condition to bias the ejector pin toward said extended condition. The method also includes forming the pilot mounting aperture in a first face of the first die member. The method also includes forming at least one threaded fastener aperture in the first face of the first die member at a preselected, laterally spaced apart position from the pilot mounting aperture. The method includes inserting at least a portion of the inner end portion of the pilot into the pilot mounting aperture in the first face of the first die member. The method further includes forming a generally plate shaped window mount for operably retaining the pilot in the pilot mounting aperture in said one die member in an installed condition. The method includes forming at least one fastener aperture in a marginal portion of the window mount which extends laterally therethrough. The method also includes positioning at least one threaded fastener in the fastener aperture of the window mount with the threaded shank portion thereof anchored in the fastener mounting aperture in the one die member to securely, yet detachably retain said window mount on the one die member. The method also includes forming a pilot mounting pocket in a central portion of the window mount with an outer pocket portion oriented toward the stock strip and closely receiving therein the outer collar portion of the pilot in said installed condition, an inner pocket portion oriented away from the stock strip and closely receiving therein the inner collar portion of the pilot in the installed condition, and an annularly shaped, radially oriented support ledge disposed therebetween which abuttingly engages the shoulder on the pilot in the installed condition to securely and positively locate the pilot in a precisely centered orientation in the pilot mounting aperture in the one die member, whereby the ejector pin automatically reciprocates between the retracted and extended positions relative to the pilot during operation of the metal forming die to insure that the stock strip is consistently stripped away from the outer end portion of the pilot.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
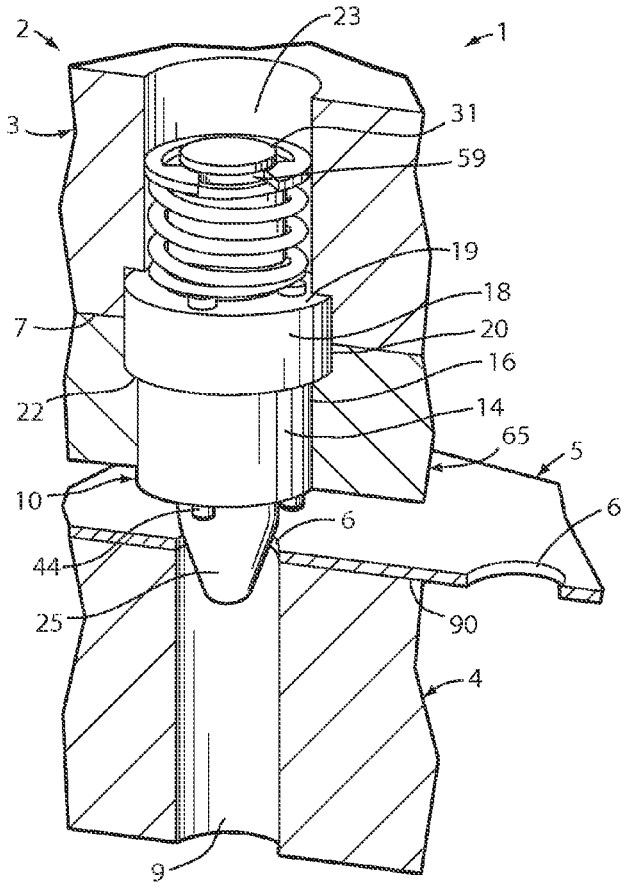
FIG. 1 is a perspective view of a modular pilot assembly with self-contained stripper embodying the present invention, shown installed in a die set carrying a stock strip in which pilot holes have been formed.
Figure 3:
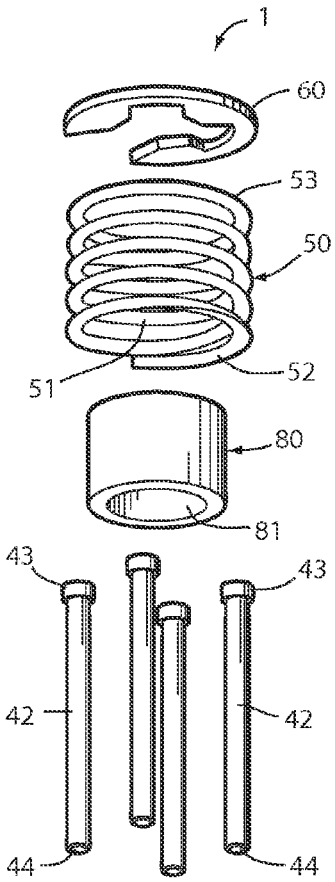
FIG. 3 is a perspective view of the pilot assembly in an assembled condition, taken from an outer end thereof.
Figure 3:
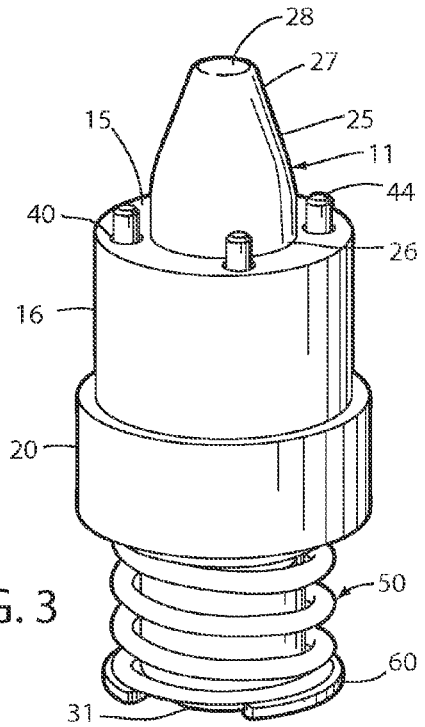
Figure 2:
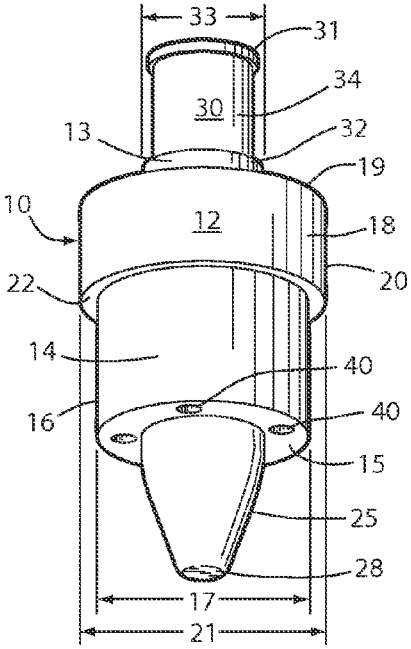
FIG. 2 is an exploded perspective view of the pilot assembly shown in FIG. 1.
Figure 3A:
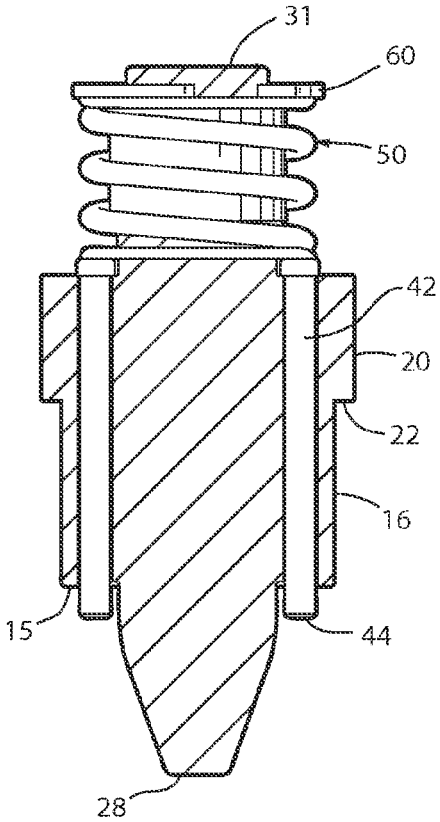
FIG. 3A is a vertical cross-sectional view of the portion of the pilot assembly shown in FIG. 3.
Figure 4:
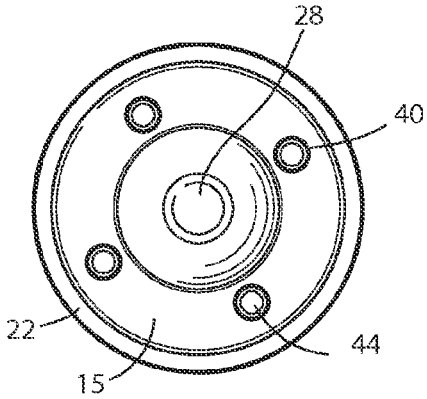
FIG. 4 is a top plan view of the pilot assembly as show in the orientation of FIG. 3.

For purposes of description herein, the terms "upper," "lower," "right," "left," "rear," "front," "vertical," "horizontal" and derivatives thereof shall relate to the invention as oriented in FIGS. 1, 2 and 3A. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1-4, 6-8, and 15-18) generally designates a modular pilot assembly with self-contained stripper embodying an aspect of the present invention. As shown in FIG. 1, the pilot assembly 1 is particularly adapted for use in conjunction with a multi-station progressive metal forming die 2, having at least two mutually converging and diverging die members 3 and 4, between which an elongate stock strip 5 is shifted longitudinally to form parts from the stock strip.

The modular pilot assembly includes a generally cylindrically shaped pilot 10 operably supported on one of the die members 3. The pilot includes an outer end portion 11 oriented toward the stock strip 5, an oppositely disposed inner end portion 13 oriented away from the stock strip 5, and a medial portion 12 disposed axially between said outer 11 and inner 13 end portions. The medial portion 12 has an outer collar portion 14 with an outer end surface 15 oriented toward the stock strip and a generally cylindrical first sidewall 16 with a first outside diameter 17, an inner collar portion 18 with an inner end surface 19 oriented away from the stock strip 5 and a generally cylindrical second sidewall 20 with a second outside diameter 21 which is greater than the first outside diameter 17 of the first sidewall 16 of the outer collar portion 14. The inner and outer collar portions define an annularly shaped, radially oriented shoulder 22 therebetween for securing the pilot 10 in an associated pilot mounting aperture 23 in the one die member 3. The medial portion of the pilot has at least one axially oriented ejector pin aperture 40 which extends through the outer end surface 15 and opens generally to the inner end surface 19. The outer end portion 11 of the pilot has a generally tapered nose 25 protruding outwardly from the outer end surface 15 of the outer collar portion 14 of the medial portion 12 of the pilot with a circularly shaped innermost portion 26 disposed adjacent the outer end surface 15 of the outer collar portion 14 configured for close reception in a pilot hole 6 in the stock strip 5. The outer end portion 11 also has a generally frusto-conically shaped outermost portion 27, with a tip 28, configured to engage the pilot hole 6 in the stock strip 5 and guide the same to a predetermined position in an associated die forming station. The inner end portion 13 of the pilot has a generally cylindrically shaped spring retainer rod 30 protruding inwardly from the inner end surface 19 of the inner collar portion 18, with an inner end surface 31 oriented away from the stock strip 5 and an outer sidewall 32 with an outside diameter 33 that is less than the second outside diameter 21 of the second sidewall 20 of the inner collar portion 18 of the medial portion 12 of the pilot 10. A spring member 50, having a generally hollow interior 51, is received onto and over the spring retainer rod 30. The outer end 52 of the spring member 50 is oriented toward the stock strip 5, while the opposite inner end 53 is oriented away from the stock strip 5 and positioned adjacent to the inner end surface 31 of the spring retainer rod 30.

The pilot also has at least one rigid ejector pin 42 slidingly received and retained in the ejector pin aperture 40 in the medial portion 12 of the pilot 10. The ejector pin(s) 42 have an outer end 44 that protrudes outwardly from the outer end surface 15 of the outer collar portion 14 of the medial portion 12 when urged to an extended position to contact the stock strip 5 and strip the same away from the outer end portion 11 of the pilot 10. The ejector pin(s) 42 retract toward the medial portion 12 of the pilot 10 when urged to a retracted position. The ejector pin(s) 42 have an inner end 43 that operably engages the outer end 52 of the spring member 50 and are thereby biased outwardly by the spring member 50 toward the extended condition. A retainer 60 operably connects the inner end portion 31 of the spring retainer rod 30 with the inner end 53 of the spring member 50 in a pre-tensed condition to define a fully assembled pilot condition wherein the ejector pin 42 is biased toward the extended condition.

A generally plate shaped window mount 65 operably supports the pilot 10 in the fully assembled pilot condition in the pilot mounting aperture 23 in the one die member 3 to define an installed condition. The window has a marginal portion 66 with at least one fastener aperture 67 extending laterally therethrough, with at least one fastener 68 positioned in the fastener aperture 67 of the window mount 65 having a threaded shank portion 86 anchored in the one die 3 member to securely, yet detachably retain the window mount 65 on the one die member 3. The window mount 65 also has a central portion 70 with a through mounting aperture 71 having an outer pocket portion 72 oriented toward the stock strip 5 to closely receive therein the outer collar 14 portion of the pilot 10 in said installed condition. The window mount also has an inner pocket portion 73 oriented away from the stock strip 5 to closely receive therein the inner collar portion 18 of the pilot 10 in said installed condition. The window mount also has an annularly shaped, radially oriented support ledge 74 disposed therebetween which abuttingly engages the shoulder 22 on the pilot 10 in the installed condition to securely locate the pilot 10 in a precisely centered orientation in the pilot mounting aperture 23 in the one die member 3.

The ejector pin(s) 42 automatically reciprocate between the retracted and extended positions relative to the pilot 10 during operation of the metal forming die 2 to insure that the stock strip 6 is consistently stripped away from the outer end portion 11 of the pilot 10.

The term "die member," as used herein, refers to any portion of a metal forming die or die set, including, but not limited to, an upper die member or a die shoe, a lower die member or a die shoe, and all other die components, whether stationary or reciprocating, including a reciprocating pressure pad, or the like. In the illustrated example, the pilot assembly 1 is shown mounted in a reciprocating upper die pad 3 located above a lower stationary die shoe 4. However, as will be appreciated by those skilled in the art, pilot assembly 1 can be mounted in other types of die members and/or components in a variety of different positions and orientations, as necessary to precisely locate the stock strip 5 in the various workstations 102 of a metal forming die 100.

Figure 15:
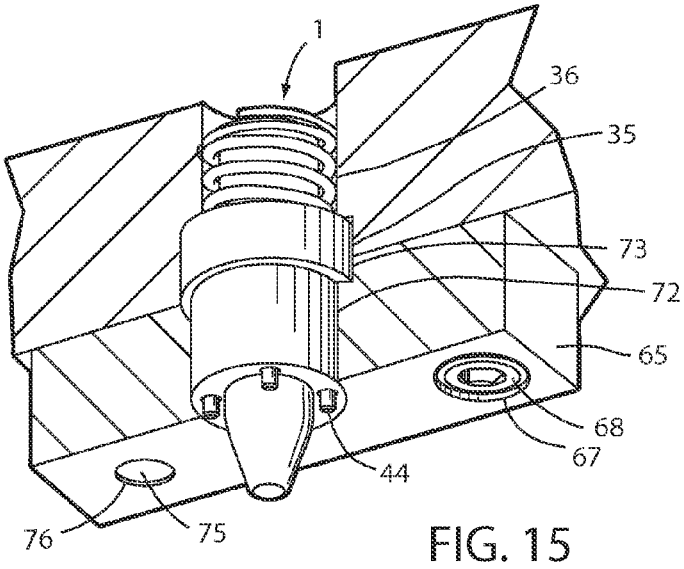
FIG. 15 is a perspective view of the modular pilot assembly shown in FIGS. 1-4 and 6-8, installed in a die member.
Figure 16:
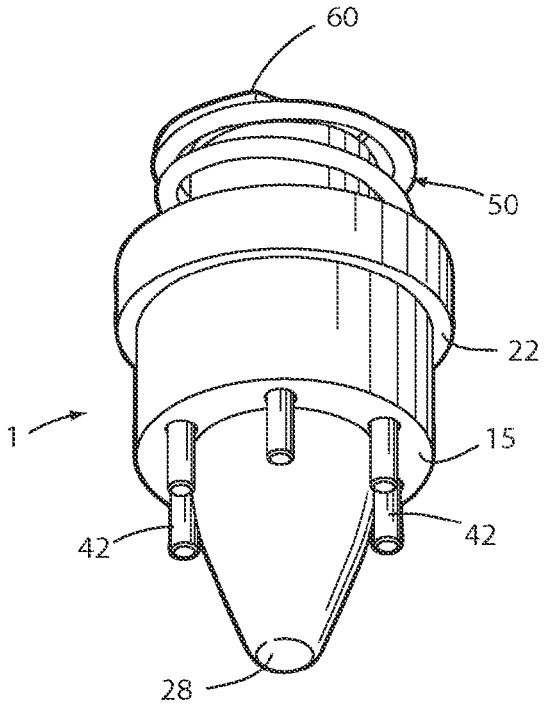
FIG. 16 is a perspective view of another embodiment of a pilot assembly with additional ejector pins.
Figure 17:
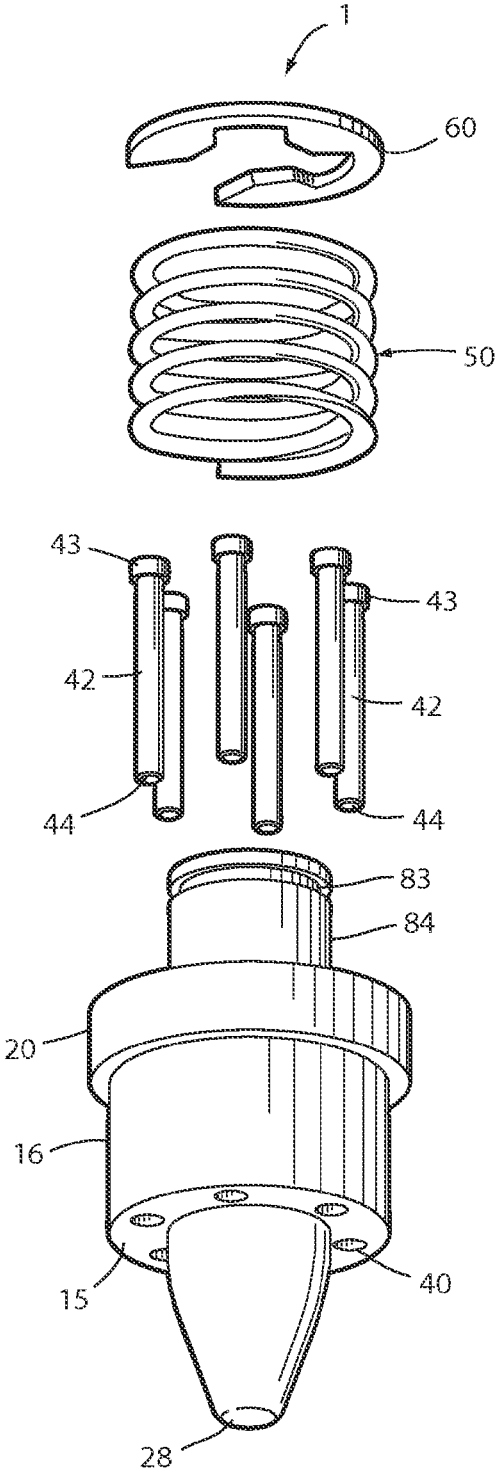
FIG. 17 is an exploded perspective view of the pilot assembly shown in FIG. 16.
Figure 18:
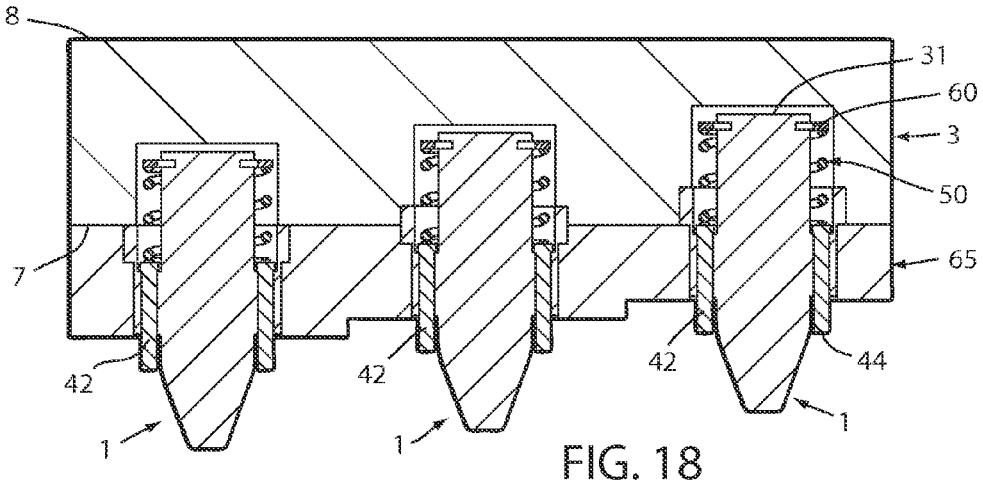
FIG. 18 is a vertical cross-sectional view of the pilot assemblies installed in various depths within a die.

The illustrated pilot 10 has a one-piece construction formed from a solid bar of rigid material, such as metal or the like. Preferably, all machining operations on the solid bar of rigid material are made during a single machine setup, so as to achieve greater accuracy and consistency of the pilot sleeve 10, as well as reduced manufacturing costs. The spring retainer rod portion 30 of the illustrated pilot 10 can include a spacer 80 (FIG. 2) disposed over the spring retainer rod 30. A portion 34 of the spring retainer rod 30 has a diameter to closely match the diameter of the interior 81 of the spacer 80. In one illustrated embodiment (FIG. 2), the portion 34 has a smaller diameter than the diameter 33 of the outer side wall 32 of the inner end portion 13 of the pilot 10. The space 59 between the spacer 80 and the inner end surface 31 of the inner end portion 13 receives the retainer 60 in one illustrated embodiment (FIG. 2). In another illustrated embodiment, no spacer 80 is used. Instead, as illustrated in FIGS. 15-17 the spring retainer rod 84 has a groove 83 for receiving the retainer 60. In the illustrated embodiments, the retainer 60 is a ring that is detachably retained in the space 59 (FIGS. 1-3A) or the groove 83 (FIGS. 16-18). The illustrated retainer 60 ring comprises a conventional, split C-ring having a generally circular lateral cross-sectional shape. However, other retainers may be used so long as they retain the spring 50 on the pilot 10.

The illustrated embodiments also show a plurality of ejector pin apertures 40 having a substantially identical configuration and arranged in a circumferentially spaced apart, mutually parallel, axially extending pattern through the medial end portion 12 of the pilot 10 to insure effective and consistent stripping of the stock strip 5 from the pilot 10. As best shown in FIGS. 2-3, the illustrated pilot 10 includes four ejector pin apertures 40 which are spaced opposite from one another on the flat outer end 15 of pilot 10, and are radially positioned close to the circularly shaped portion 26 of the outer end portion 11 of the pilot 10, so as to improve the stripping action of the same. In that illustrated embodiment, four ejector pins 42 are slidingly received and retained for reciprocation in the ejector pin apertures 40. As best illustrated in FIGS. 1, 2, and 15, the outer ends 44 of ejector pins 42 have a size and shape similar to the elongate body portions of ejector pins 42, each with a generally flat circular plan configuration best suited for abuttingly engaging the stock strip 5. The inner ends 43 of ejector pins 42 are enlarged relative to the size of the elongate body portions of ejector pins 42, and define cylindrically shaped, enlarged heads, each with a generally circular, flat inner face which facilitates engagement with the outer end 52 of spring member 50. As shown in another illustrated embodiment, the number of ejector pins 42 used in the modular pilot assembly 1 can vary. For example, FIGS. 16-17 show six ejector pins 42. While the two illustrated embodiments show four and six ejector pins 42, any number of ejector pins 42 can be used so long as they are spaced in a manner to effectively strip the stock strip 5 from the outer end portion 11 of the pilot 10.

As best illustrated in FIGS. 1-3A and 16-17, the outer end portion 11 of the pilot 10 has a relatively bullet-like profile, with a tapered nose 25 that ends to a relatively small, circular flat tip 28. However, a wide variety of differently sized and shaped outer end portions 11 of pilots 10 can be used in accordance with the desires of the die maker and/or die user.

Figure 5:
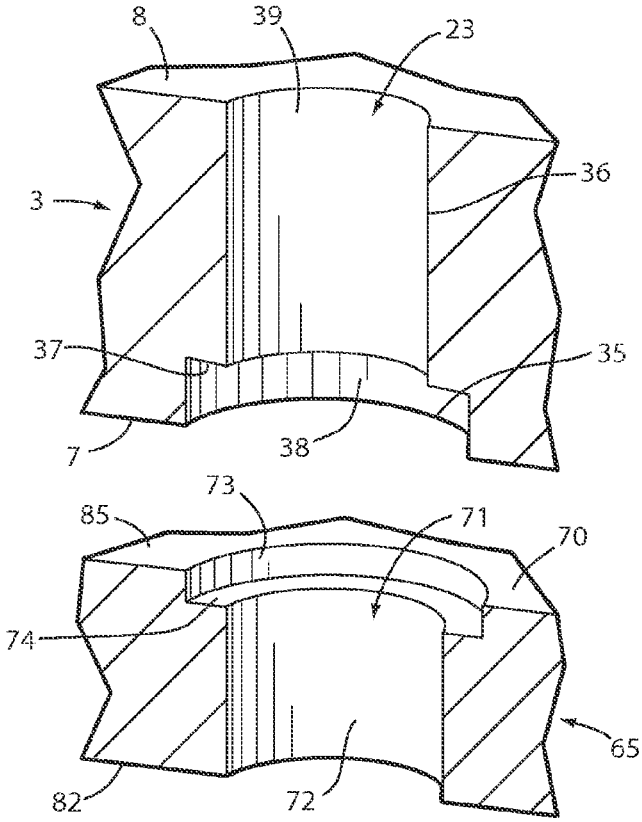
FIG. 5 is a perspective cross-elevational view of the apertures in the die member and the window mount.

In addition, the modular pilot assembly 1 can be used with different sized window mounts 65. The thickness and shape of the window mount 65 can be changed. The illustrated window mount 65 has a one-piece construction formed from a solid bar of rigid material, such as metal or the like. In addition, the machining to create surfaces to secure the pilot assembly 10 to the die 3 using a window mount 65 may be modified. For example, the machining of the aperture 23 in the die 3 and the aperture 71 in the window mount 65 can be adjusted as shown in FIGS. 5 and 18. As illustrated in FIG. 5, the aperture 23 in the die has a larger diameter portion 35 and a smaller diameter portion 36 to create a shoulder 37 in the aperture, while the aperture 71 in the window mount 65 also has a larger diameter portion 73 and a smaller diameter portion 72 to create a ledge 74 in the aperture 71. Alternatively, the lower surface 7 of the die 3 can be used as the die shoulder as shown on the left side of FIG. 18. In addition, the lower surface 7 of the die 3 can be used to create the window mount ledge as shown on the right side of FIG. 18. The ability to control the depth of the two surfaces, 37 and 74, that engage the surfaces 19 and 22 of the inner collar portion 18 of the medial portion 12 of the pilot 10 permits a wide variety of options for the die maker and/or die user for determining the depth and extent of the machining of the die 3 and/or the depth and extent of the machining of the window mount 65.

The illustrated spring member 50 comprises a conventional closed coil spring, which may have partially flattened or ground ends 52, 53 to more securely abut the inner ends 43 of ejector pins 42, as well as the bottom of the retainer 60.

Figure 6:
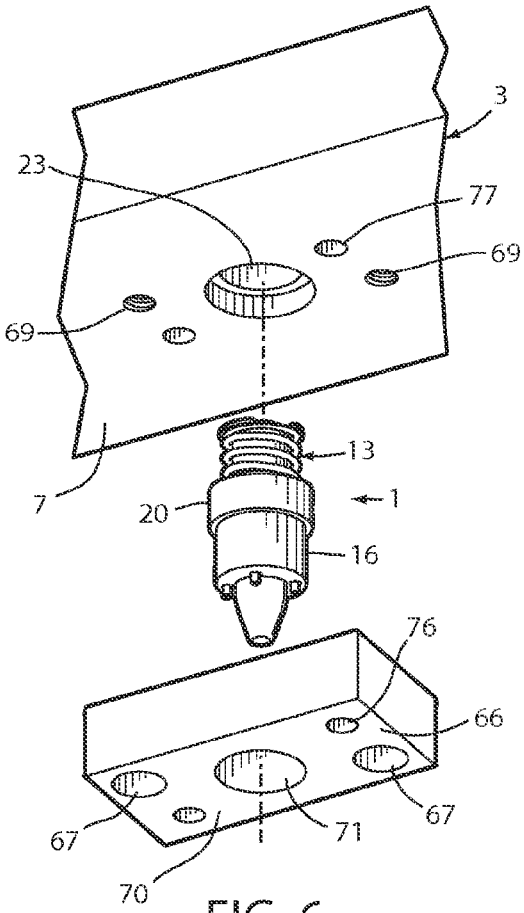
FIG. 6 is a perspective view of the pilot assembly prior to metallation in to the upper die member.
Figure 7:
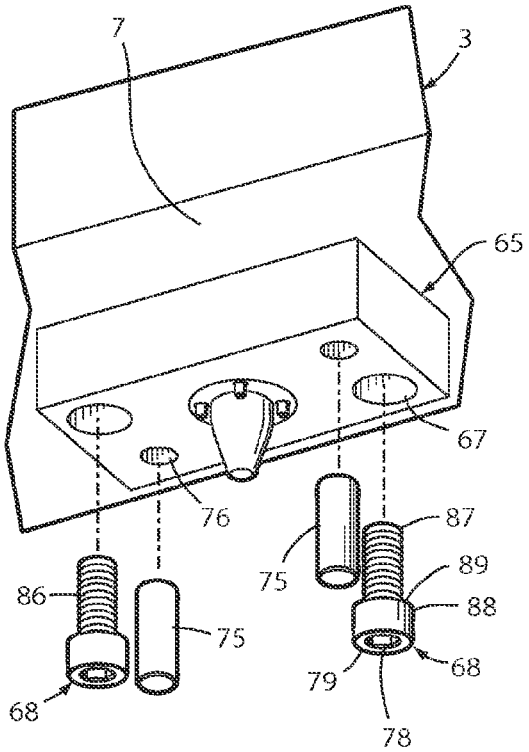
FIG. 7 is a perspective view of the pilot assembly partially installed in the die member.
Figure 8:
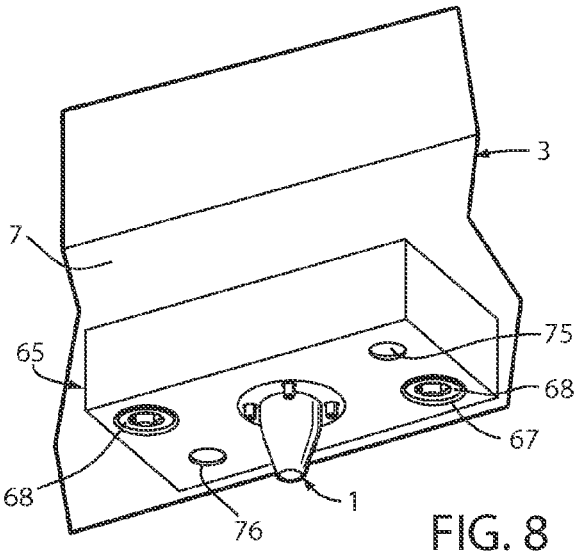
FIG. 8 is a perspective view of the pilot assembly installed in the die member.
Figure 9:
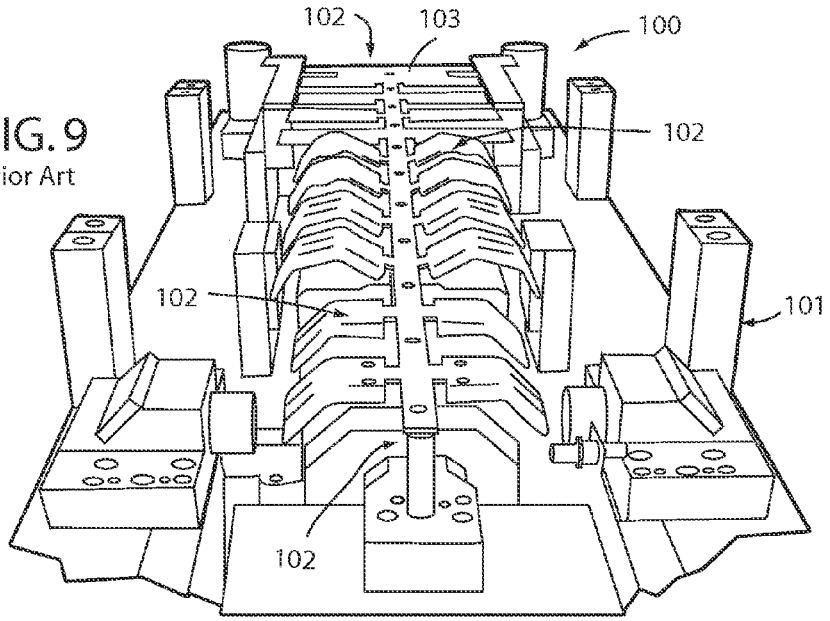
FIG. 9 Prior Art
FIG. 9 is a partially schematic perspective view of a representative prior art die member shown in an open condition with a stock strip positioned along the various work stations in the die member.
Figure 10:
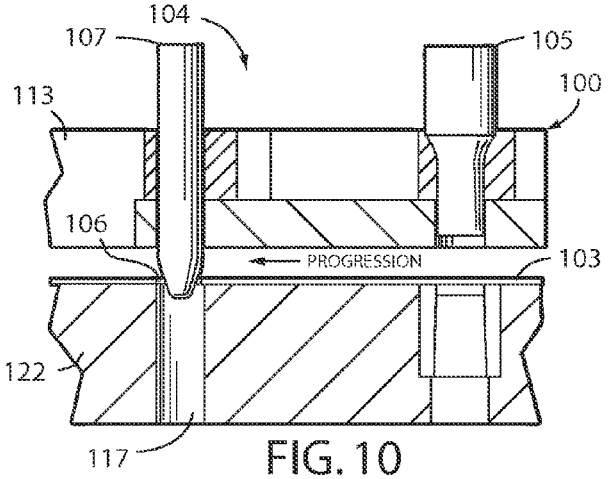
FIG. 10 Prior Art
FIG. 10 is a partially schematic cross-sectional view of a prior art pilot.
Figure 11:
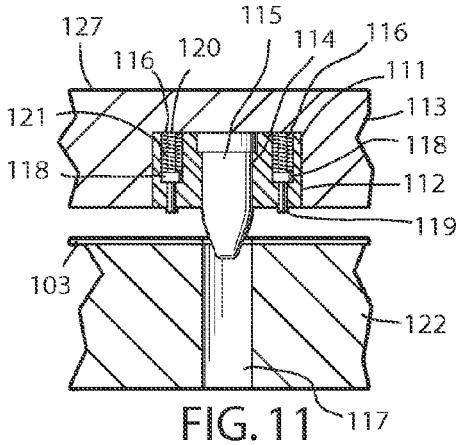
FIG. 11 Prior Art
FIG. 11 is a partially schematic cross-sectional view of another prior art pilot.
Figure 12:
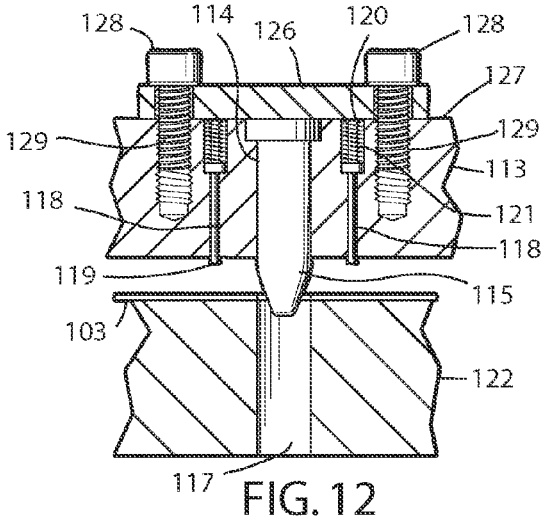
FIG. 12 Prior Art
FIG. 12 is a partially schematic cross-sectional view of yet another prior art pilot.
Figure 13:
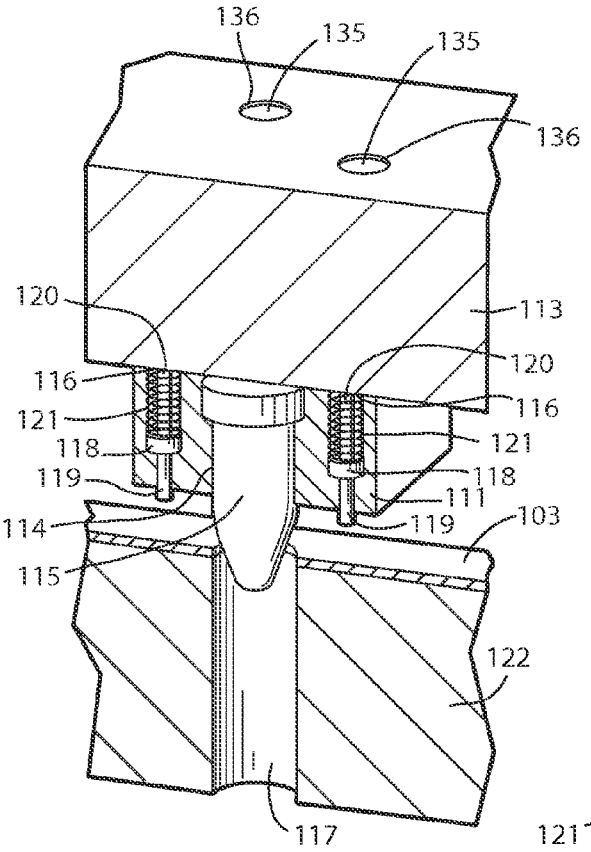
FIG. 13 Prior Art
FIG. 13 is a perspective view of another prior art pilot.
Figure 14:
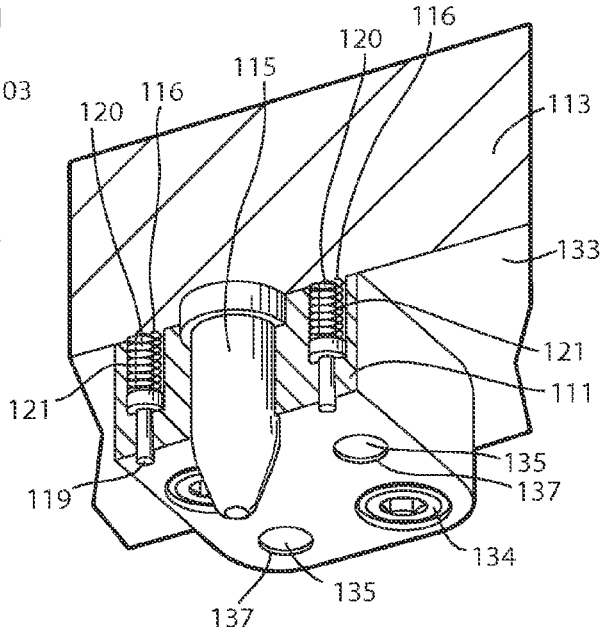
FIG. 14 Prior Art
FIG. 14 is a perspective view of the prior art pilot shown in FIG. 13.

With reference to FIGS. 6-8, the illustrated fastener 68 comprises a conventional socket head cap bolt having a tool engaging socket 78 in the outer face 79 of the head portion 80 of fastener 68, opposite inner face 87, and a threaded shank portion 86. The threaded shank portion can include a self-locking nylon patch which prevents fastener 68 from inadvertently loosening from its tightened condition in die member 3 and window mount 65. The fastener may be any fastener, including but not limited to a bolt or screw. The inner surface 89 of head 88 of the fastener 68 may abut a shoulder in the fastener aperture 67 of window mount 65. As illustrated, the threaded fastener aperture 69 in the die 3 is designed to receive a portion or all of the threaded shank 86 of the fastener 68 depending upon the depth of the shoulder in the fastener aperture 67 of the window mount 65 and whether there is a threading in the fastener aperture 67. Optionally, one or more dowels 75 may be used to help locate the window mount 65 with respect to the die 3. If dowels 75 are to be used, dowel holes 76 in the window mount and dowel holes 77 in the upper die 3 are machined to closely receive the dowels 75.

With reference to FIGS. 6-8 and 15, the assembled pilot assembly 1 is quickly and easily installed in the illustrated upper die pad 3 in the following manner. Initially, a non-threaded pilot mounting aperture 23 is formed in the lower or mounting face 7 of the upper die pad 3 using simple machining techniques and no special tooling, and is shaped to closely receive and retain the pilot 10 therein. The illustrated aperture 23 (FIG. 5) has a stepped construction, with a larger diameter aperture 35 defined by sidewall 38 disposed closest to stock strip 5 and lower die mounting surface 7, and a smaller diameter aperture 36 defined by sidewall 39, disposed further away from the stock strip 5 and lower die mounting surface 7, with an annular lip or shoulder 37 formed therebetween. The aperture 23 can extend to the upper surface 8 of the die 3 as shown in FIGS. 5 and 15 or can terminate in between the lower surface 7 and the upper surface 8 as shown in FIG. 18. The second sidewall 20 of the pilot 10 fits closely within the larger aperture 35 of the pilot mounting aperture 23 such that the inner end surface 19 at the pilot 10 engages shoulder 37 to axially locate the assembled pilot 10 within pilot aperture 23. The inner end portion 13 fits within the smaller diameter aperture 36 of the pilot mounting aperture 23. The smaller diameter aperture 36 must be sufficiently wide so as to not restrict movement of the spring member 50 when the pilot 10 is in the installed condition.

Once the assembled pilot 1 is inserted into the pilot mounting aperture 23, the window mount 65 is placed over the pilot 10. A portion of the second sidewall 20 of the pilot 10 fits closely within the inner pocket portion 73 (FIG. 5) of the window mount 65, while the first sidewall 16 fits closely within the outer pocket portion 72 of window mount 65. As illustrated in FIGS. 1, 7, 8, 15, and 18, the outer end surface 15 of the outer collar 14 of the medial portion 12 of the pilot 10 may be generally flush with the outer surface 82 of the window mount 65 when the pilot 10 is in the assembled condition. The inner surface 85 of the window mount 65 abuts the lower surface 7 of the die when the pilot 10 is in the installed condition. One or more fasteners 68 are used to secure the window mount 65 to the die 3. Optionally, one or more dowels 75 can be used to help locate the window mount 65 on the lower surface 7 of the die 3 as described above.

Figure 19:
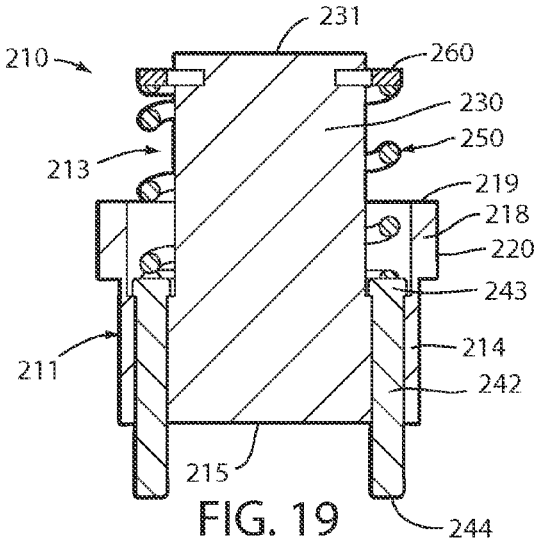
FIG. 19 is a vertical cross-sectional view of a self-contained modular stripper assembly.
Figure 21:
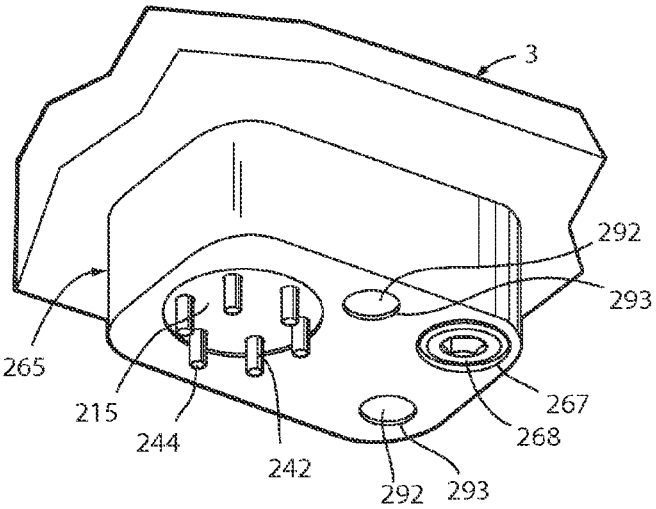
FIG. 21 is a perspective view of the self-contained modular stripper assembly shown in FIGS. 19-20, installed in a die member.
Figure 20:
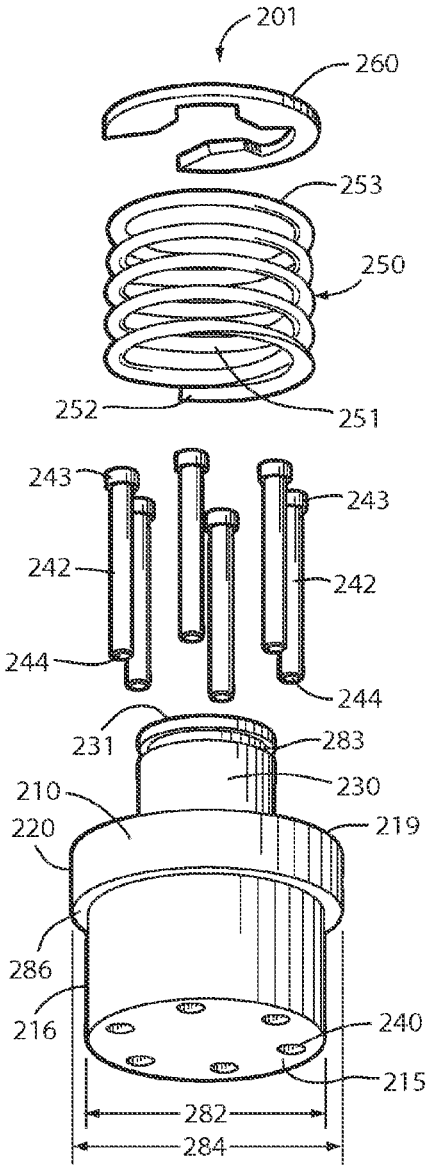
FIG. 20 is an exploded perspective view of the self-contained modular stripper assembly shown in FIG. 19.

In yet another embodiment, a modular stripper assembly 201 is shown in FIGS. 19-21. The modular stripper assembly 201 is similar to the modular pilot assemblies 1 shown in FIGS. 1-8 and 15-18 without the inner end portion 13 of the pilot 10. The modular stripper assembly 201 includes a stripper 210 with an inner end portion 213 and an outer end portion 211. The outer end portion 211 is similar in shape to the medial portion 12 of the pilot 10 shown in FIGS. 1-8. The outer end portion 211 has an outer collar portion 214 with an outer end surface 215 that faces the stock strip. The outer collar portion 214 has a generally cylindrical first sidewall 216 with a first outside diameter 282. The outer end portion 211 also has an inner collar portion 218 with an inner end surface 219. The inner collar portion 218 has a generally cylindrical second sidewall 220 with a second outside diameter 284 that is greater than the first outside diameter 282. A shoulder 286 is formed on the outside surface of the inner collar portion. The width of the shoulder 286 is due to the difference between the outside diameters 282, 284.

Ejector pin apertures 240 are formed in the outer end portion 211 such that the apertures extend from the outer end surface 215 to the inner end surface 219. One or more ejector pins 242 are received in the corresponding ejector pin apertures 240. The ejector pins 242 have outer ends 244 and inner ends 243.

The inner end portion 213 includes a spring retainer rod portion 230 with an inner end surface 231. A groove 283 is formed in the inner end portion 213 for receiving a retainer 260. A spring member 250 has a hollow interior 251, which is received over the spring retainer rod portion 230. The lower end surface 252 of the spring member 250 may be relatively flat and touches the inner end portions 243 of the ejector pins 242 when the ejector pins 242 are installed in the associated apertures 240.

The retainer 260 operably connects the inner end portion 231 of the spring retainer rob 230 with the inner end 253 of the spring member 250 in a pre-tensed condition to define a fully assembled stripper condition wherein the ejector pins 242 are biased towards an extended condition such that the outer ends 244 of the ejector pins 242 are extended towards the stock strip. The outer ends 244 of the ejector pins 242, when urged in to an extended condition, contact the stock strip to the strip the same away from the die 3. The ejector pins 242 retract when the dies 3, 4 are pressed together such that they are in a retracted condition.

The stripper 210 is installed on a die 2 in much the same manner as the pilot 10 is installed on a die 3 as described above. A window mount 265 is used to operably support the stripper 210 in the fully assembled stripper condition (FIG. 21) in association with a stripper mounting aperture in the die member 3 to define an installed condition. The window mount 265 has at least one fastener aperture 267. A threaded fastener 268 is used to attach the window mount 265 to the die member as described above in the context of the pilot mounting assembly. In addition, dowels 292 may be used to locate the window mount 265 on the die 3 via dowel apertures 293 in the window mount 265 and associated apertures on the die 3.

The pilot assembly 1 and the stripper assembly 201 may be readily removed from die member 3 by simply reversing the sequence of the installation steps described above.

FIG. 1 illustrates the operation of pilot assembly 1. The upper pressure pad 3 with pilot assembly 1 mounted therein converges against the stock strip 5 that is supported on the upper surface 40 of the lower die member 4. In this position, the ejector pins 42 are fully extended, and have yet to abut against the upper surface of the stock strip 5. The tapered nose 25 of the pilot 10 is received through the most closely aligned one of the pilot holes 6 in stock strip 5 and into the female pilot pad portion 9 in the bottom or lower die member 4. Next, the upper die pad 3 converges or closes completely against the stock strip 5 and lower die member 4 supporting the same, such that the abutting contact between the outer ends 44 of the ejector pins 42 and the upper surface of the stock strip 5 overcome the biasing force of pretensed spring member 50 on ejector pins 42, further compressing spring member 50, while shifting and/or retracting the ejector pins 42 back toward the interior of the outer end portion 11 of pilot 10. The tip 28, tapered nose 25, and most if not all of the remaining portion of the inner end portion 13 of the pilot 10 is thus received in the aligned pilot hole 6 in stock strip 5 and the female pilot portion 9 in the bottom die member 4. The metal forming operation in the associated die work station is then completed with the pilot assembly 1 such that the stock strip 5 is precisely located and securely held in place during formation and further processing of stock strip 5. As the upper die pad 3 diverges or moves away from the stock strip 5 and the lower die member 4, the resilient force generated by spring member 50, urges the ejector pins 42 back outwardly toward and abuttingly against the stock strip 5 and separates or strips the stock strip 5 from the pilot 10, such that the stock strip 5 can then be quickly shifted longitudinally to the next work station for further processing.

The stripper assembly 201 can be installed in the same manner. While the stripper assembly 201 does not help locate the stock strip 5 in the work station, it does help strip the stock strip 5 away from the associated die 3.

As will be appreciated by those skilled in the art, pilot assembly 1 and stripper assembly 201 can be provided in a wide variety of different sizes to accommodate many different metal forming die applications. The all-in-one, modular construction of pilot assembly 1 and stripper assembly 201 not only provides a self-contained stock stripper that uses only one spring, but can be quickly and easily installed directly in a die member using simple machining techniques, a window mount and one or more mounting screws.

Pilot assembly 1 and stripper assembly 201 have an uncomplicated construction with relatively few components and is therefore quite durable and economical to manufacture. The mounting screw(s) and window mount attachment of the pilot assembly and stripper assembly to an associated die member provides quick and easy installation and removal. The spring member 50 and assembly are backed up or axially supported by the die member itself for greater strength and convenience. Pilot assembly 1 and stripper assembly 201 have a self-contained stripper which positively separates the stock strip from the die during operation of the metal forming die, and provides a very compact, low profile shape that can be used at various locations and orientations on the various die members. The installation of the pilot assembly 1 and/or stripper assembly 201 can be achieved with simple machining, so as to reduce installation time and cost. The shape of the assemblies can be configured, so as to accommodate many different applications and users.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a multi-station progressive metal forming die having at least two mutually converging and diverging die members between which an elongate stock strip is shifted longitudinally to form parts from the stock strip, the improvement of a modular pilot assembly with self-contained stripper, comprising:

a generally cylindrically shaped pilot operably supported on one of said die members and having an outer end portion oriented toward the stock strip, an oppositely disposed inner end portion oriented away from the stock strip, and a medial portion disposed axially between said outer and inner end portions, wherein:

said medial portion has an outer collar portion with an outer end surface oriented toward the stock strip and a generally cylindrical first sidewall with a first outside diameter, an inner collar portion with an inner end surface oriented away from the stock strip and a generally cylindrical second sidewall with a second outside diameter which is greater than said first outside diameter of said first sidewall of said outer collar portion and defines an annularly shaped, radially oriented shoulder therebetween for securing said pilot in an associated pilot mounting aperture in said one die member, and at least one axially oriented ejector pin aperture which extends through said outer end surface and opens generally to said inner end surface;

said outer end portion has a generally tapered nose protruding outwardly from said outer end surface of said outer collar portion, with a circularly shaped innermost portion disposed adjacent said outer end surface of said outer collar portion configured for close reception in a pilot hole in the stock strip, and a generally conically shaped outermost portion configured to engage the pilot hole in the stock strip and guide the stock strip to a predetermined position in an associated die forming station;

said inner end portion has a generally cylindrically shaped spring retainer rod protruding inwardly from said inner end surface of said inner collar portion, with an inner end surface of the spring retainer rod oriented away from the stock strip and an outer sidewall with an outside diameter that is less than said second outside diameter of said second sidewall of said inner collar portion;

a spring member having a generally hollow interior that is received onto and over said spring retainer rod, an outer end oriented toward the stock strip, and an opposite inner end oriented away from the stock strip and positioned adjacent to said inner end surface of said spring retainer rod;

at least one rigid ejector pin slidingly received and retained in said ejector pin aperture in said medial portion of said pilot, the rigid ejector pin having an outer end that protrudes outwardly from said outer end surface of said outer collar portion of said medial portion when urged to an extended position to contact the stock strip and strip the stock strip away from said outer end portion of said pilot, and retracts toward said medial portion of said pilot when urged to a retracted position, and an inner end of the rigid ejector pin that operably engages said outer end of said spring member and is thereby biased outwardly by said spring member toward said extended condition;

a retainer operably connecting said inner end portion of said spring retainer rod with said inner end of said spring member in a pre-tensed condition to define a fully assembled pilot condition wherein said ejector pin is biased toward said extended condition; and a window mount operably supporting said pilot in said fully assembled pilot condition in said pilot mounting aperture in said one die member to define an installed condition, and having:

a marginal portion with at least one fastener aperture extending laterally therethrough;

at least one fastener positioned in said fastener aperture of said window mount and having a threaded shank portion anchored in said one die member to securely, yet detachably retain said window mount on said one die member;

a central portion with a through mounting aperture for receiving said pilot, whereby said ejector pin automatically reciprocates between said retracted and extended positions relative to said pilot during operation of said metal forming die to insure that the stock strip is consistently stripped away from said outer end portion of said pilot.

2. A metal forming die as set forth in claim 1, wherein:

said central portion of said window mount has an outer pocket portion oriented toward the stock strip and closely receiving therein said outer collar portion of said pilot in said installed condition, an inner pocket portion oriented away from the stock strip and closely receiving therein said inner collar portion of said pilot in said installed condition, and an annularly shaped, radially oriented support ledge disposed therebetween which abuttingly engages said shoulder on said pilot in said installed condition to securely locate said pilot in a precisely centered orientation condition in said pilot mounting aperture in said one die member.

3. A metal forming die as set forth in claim 2, including:

a rigid generally hollow cylindrically shaped spacer operably positioned between said spring retainer rod on said inner end portion of said pilot and said spring member in said fully assembled pilot condition to retain said spring member in a concentric relationship with said inner end portion of said pilot and insure full contact between said outer end of said spring member and said inner end of said ejector pin.

4. A metal forming die as set forth in claim 3, wherein:

said spring retainer rod on said inner end of said pilot includes a circumferentially extending retainer groove disposed adjacent said inner end surface of said spring retainer rod; and said retainer comprises a retainer ring received in said retainer groove which positively yet detachably retains said pilot, said ejector pin and said spring member in said fully assembled condition as a single assembly.

5. A metal forming die as set forth in claim 4, wherein:

said pilot mounting aperture in said one die member includes a non-threaded outer bore portion oriented away from the stock strip with an inside diameter selected to loosely receive and retain therein said outer end portion of said pilot, said spring member and said retainer ring in said fully assembled and installed condition, a non-threaded inner bore portion oriented toward the stock strip with an inside diameter of the inner bore portion that is substantially the same as said first outside diameter of said first sidewall of said outer collar portion of said medial portion of said pilot to closely receive and retain the pilot therein, and an annularly shaped, radially oriented support surface therebetween which abuttingly engages said inner end surface of said inner end portion of said pilot, such that said outer collar portion of said medial portion of said pilot is positively captured between said support surface of said pilot mounting aperture in said one die member and said support ledge in said window mount.

6. A metal forming die as set forth in claim 5, wherein:

said pilot has a one-piece construction formed from a solid bar of rigid material.

7. A metal forming die as set forth in claim 6, wherein:

said medial portion of said pilot includes a plurality of said ejector pin apertures having equal diameters and arranged in a circumferentially spaced apart, mutually parallel, axially extending pattern through said medial portion to insure effective stripping of the stock strip from said outer end portion of said pilot; and including a plurality of said ejector pins having a substantially identical configuration and slidingly received and retained in said ejector pin apertures in said medial portion of said pilot.

8. A metal forming die as set forth in claim 7, wherein:

said outer ends of said ejector pins selectively project from said ejector pin apertures in said medial portion of said pilot at locations immediately adjacent said innermost portion of said nose to insure effective stripping of the stock strip from said outer end portion of said pilot.

9. A metal forming die as set forth in claim 8, wherein:

said outer ends of said ejector pins have a flat, generally circular plan shape to facilitate stripping the stock strip from said pilot; and said inner ends of said ejector pins have a flat, generally circular plan shape to facilitate abutting engagement with said outer end of said spring member.

10. A metal forming die as set forth in claim 9, wherein:

said retainer ring comprises a split snap ring.

11. A metal forming die as set forth in claim 10, wherein:

said medial portion of said pilot and said tapered nose of said pilot are arranged in a generally concentric relationship.

12. A metal forming die as set forth in claim 11, wherein:

said outermost portion of said nose on said outer end portion of said pilot has a generally frustro-conical shape.

13. A metal forming die as set forth in claim 12, wherein:

said through mounting aperture in said central portion of said window mount is non-threaded.

14. A metal forming die as set forth in claim 13, wherein:

said one die member comprises a reciprocating die pad.

15. A metal forming die as set forth in claim 14, wherein:

said fastener is a threaded bolt.

16. A modular pilot assembly with self-contained stripper for multi-station progressive metal forming dies having at least two mutually converging and diverging die members between which an elongate stock strip is shifted longitudinally to form parts from the stock strip, comprising:

a generally cylindrically shaped pilot configured for operable support on one of the die members and having an outer end portion oriented toward the stock strip, an oppositely disposed inner end portion oriented away from the stock strip, and a medial portion disposed axially between said outer and inner end portions, wherein:

said medial portion has an outer collar portion with an outer end surface oriented toward the stock strip and a generally cylindrical first sidewall with a first outside diameter, an inner collar portion with an inner end surface oriented away from the stock strip and a generally cylindrical second sidewall with a second outside diameter which is greater that said first outside diameter of said first sidewall of said outer collar portion and defines an annularly shaped, radially oriented shoulder therebetween for securing said pilot in an associated pilot mounting aperture in the one die member, and at least one axially oriented ejector pin aperture which extends through said outer end surface and opens generally to said inner end surface;

said outer end portion has a generally tapered nose protruding outwardly from said outer end surface of said outer collar portion, with a circularly shaped innermost portion disposed adjacent said outer end surface of said outer collar portion configured for close reception in a pilot hole in the stock strip, and a generally conically shaped outermost portion configured to engage the pilot hole in the stock strip and guide the stock strip to a predetermined position in an associated die forming station;

said inner end portion has a generally cylindrically shaped spring retainer rod protruding inwardly from said inner end surface of said inner collar portion, with an inner end portion of the spring retainer rod oriented away from the stock strip and an outer sidewall with an outside diameter that is less than said second outside diameter of said second sidewall of said inner collar portion;

a spring member having a generally hollow interior that is received onto and over said spring retainer rod, an outer end oriented toward the stock strip, and an opposite inner end oriented away from the stock strip and positioned adjacent to said inner end surface of said spring retainer rod;

at least one rigid ejector pin slidingly received and retained in said ejector pin aperture in said medial portion of said pilot, the rigid ejector pin having an outer end that protrudes outwardly from said outer end surface of said outer collar portion of said medial portion when urged to an extended condition to contact the stock strip and strip the stock strip away from said outer end portion of said pilot, and retracts toward said medial portion of said pilot when urged to a retracted position, and an inner end of the rigid ejector pin that operably engages said outer end of said spring member and is thereby biased outwardly by said spring member toward said extended condition;

a retainer operably connecting said inner end portion of said spring retainer rod with said inner end of said spring member in a pre-tensed condition to define a fully assembled condition wherein said ejector pin is biased toward said extended condition; and a generally plate shaped window mount for operably supporting said pilot in said fully assembled pilot condition in the pilot mounting aperture in the one die member to define an installed condition, and having:

a marginal portion with at least one fastener aperture extending laterally therethrough;

at least one fastener positioned in said fastener aperture of said window mount and having a threaded shank portion configured for anchoring in the one die member to securely, yet detachably retain said window mount on the one die member;

a central portion with a through mounting aperture for receiving said pilot, whereby said ejector pin automatically reciprocates between said retracted and extended positions relative to said pilot during operation of the metal forming die to insure that the stock strip is consistently stripped away from said outer end portion of said pilot.

17. A modular pilot assembly as set forth in claim 16, wherein:

said central portion of said window mount has an outer pocket portion oriented toward the stock strip and closely receiving therein said outer collar portion of said pilot in said installed condition, an inner pocket portion oriented away from the stock strip and closely receiving therein said inner collar portion of said pilot in said installed condition, and an annularly shaped, radially oriented support ledge disposed therebetween which abuttingly engages said shoulder on said pilot in said installed condition to securely locate said pilot in a precisely centered orientation condition in said pilot mounting aperture in said one die member.

18. A modular pilot assembly as set forth in claim 17, including:

a rigid generally hollow cylindrically shaped spacer operably positioned between said spring retainer rod on said inner end portion of said pilot and said spring member in said fully assembled pilot condition to retain said spring member in a concentric relationship with said inner end portion of said pilot and insure full contact between said outer end of said spring member and said inner end of said ejector pin.

19. A modular pilot assembly as set forth in claim 18, wherein:

said spring retainer rod on said inner end of said pilot includes a circumferentially extending retainer groove disposed adjacent said inner end surface of said spring retainer rod; and said retainer comprises a retainer ring received in said retainer groove which positively yet detachably retains said pilot, said ejector pin and said spring member in said fully assembled condition as a single assembly.

20. A modular pilot assembly as set forth in claim 19, wherein:

said pilot mounting aperture in said one die member includes a non-threaded outer bore portion oriented away from the stock strip with an inside diameter selected to loosely receive and retain therein said outer end portion of said pilot, said spring member and said retainer ring in said fully assembled and installed condition, a non-threaded inner bore portion oriented toward the stock strip with an inside diameter of the inner bore portion that is substantially the same as said first outside diameter of said first sidewall of said outer collar portion of said medial portion of said pilot to closely receive and retain the pilot therein, and an annularly shaped, radially oriented support surface therebetween which abuttingly engages said inner end surface of said inner end portion of said pilot, such that said outer collar portion of said medial portion of said pilot is positively captured between said support surface of said pilot mounting aperture in said one die member and said support ledge in said window mount.

21. A modular pilot assembly as set forth in claim 20, wherein:

said pilot has a one-piece construction formed from a solid bar of rigid material.

22. A modular pilot assembly as set forth in claim 21, wherein:

said medial portion of said pilot includes a plurality of said ejector pin apertures having equal dimeters and arranged in a circumferentially spaced apart, mutually parallel, axially extending pattern through said medial portion to insure effective stripping of the stock strip from said outer end portion of said pilot; and including a plurality of said ejector pins having a substantially identical configuration and slidingly received and retained in said ejector pin apertures in said medial portion of said pilot.

23. A modular pilot assembly as set forth in claim 22, wherein:

said outer ends of said ejector pins selectively project from said ejector pin apertures in said medial portion of said pilot at locations immediately adjacent said innermost portion of said nose to insure effective stripping of the stock strip from said outer end portion of said pilot.

24. A modular pilot assembly as set forth in claim 23, wherein:

said outer ends of said ejector pins have a flat, generally circular plan shape to facilitate stripping the stock strip from said pilot; and said inner ends of said ejector pins have a flat, generally circular plan shape to facilitate abutting engagement with said outer end of said spring member.

25. A modular pilot assembly as set forth in claim 24, wherein:

said retainer ring comprises a split snap ring.

26. A modular pilot assembly as set forth in claim 25, wherein:

said medial portion of said pilot and said tapered nose of said pilot are arranged in a generally concentric relationship.

27. A modular pilot assembly as set forth in claim 26, wherein:

said outermost portion of said nose on said outer end portion of said pilot has a generally frustro-conical shape.

28. A modular pilot assembly as set forth in claim 27, wherein:

said through mounting aperture in said central portion of said window mount is non-threaded.

29. A modular pilot assembly as set forth in claim 28, wherein:

said one die member comprises a reciprocating die pad.

30. A modular pilot assembly as set forth in claim 29, wherein:

said fastener is a threaded bolt.

31. In a method for making a multi-station progressive metal forming die having at least two mutually converging and diverging die members between which an elongate stock strip is shifted longitudinally to form parts from the stock strip, with the improvement of at least one modular pilot assembly with self-contained stripper for precisely locating the stock strip in the die stations, comprising:

forming a generally cylindrically shaped pilot for operable support on one of the die members with an outer end portion oriented toward the stock strip, an oppositely disposed inner end portion oriented away from the stock strip, and a medial portion disposed axially between the outer and inner end portions, and including:

forming the medial portion with an outer collar portion having an outer end surface oriented toward the stock strip and a generally cylindrical first sidewall with a first outside diameter, an inner collar portion having an inner end surface oriented away from the stock strip and a generally cylindrical second sidewall with a second outside diameter which is greater that the first outside diameter of the first sidewall of the outer collar portion and defines an annularly shaped, radially oriented shoulder therebetween for securing the pilot in an associated pilot mounting aperture in the one die member, and at least one axially oriented ejector pin aperture which extends through the outer end surface and opens generally to the inner end surface;

forming the outer end portion with a generally tapered nose protruding outwardly from the outer end surface of the outer collar portion, having a circularly shaped innermost portion disposed adjacent the outer end surface of the outer collar portion and configured for close reception in a pilot hole in the stock strip, and a generally conically shaped outermost portion configured to engage the pilot hole in the stock strip and guide the stock strip to a predetermined position in an associated die forming station;

forming the inner end portion with a generally cylindrically shaped spring retainer rod protruding inwardly from the inner end surface of the inner collar portion, with an inner end surface of the spring retainer rod oriented away from the stock strip and an outer sidewall with an outside diameter that is less than the second outside diameter of the second sidewall of the inner collar portion;

forming at least one rigid ejector pin with an inner end, and an outer end configured to protrude outwardly from the outer end surface of the outer collar portion of the medial portion when urged to an extended condition to contact the stock strip and to retract inwardly toward the medial portion of the pilot when urged to a retracted position;

inserting the ejector pin into the ejector pin aperture in the medial portion of the pilot, such that the ejector pin is slidingly received and retained in the ejector pin aperture for longitudinal reciprocation between the extended and retracted positions;

selecting a spring member with a generally hollow interior, an outer end of the spring member oriented toward the stock strip, and an opposite inner end of the spring member oriented away from the stock strip;

positioning the hollow interior of the spring member onto and over the spring retainer rod on the inner end portion of the pilot, with the outer end of the spring member abutting the inner end of the ejector pin;

operably connecting the inner end of the spring member with the spring retainer rod adjacent the inner end surface thereof in a pre-tensed condition to bias the ejector pin toward said extended condition;

forming the pilot mounting aperture in a first face of the first die member;

forming at least one threaded fastener aperture in the first face of the first die member at a preselected, laterally spaced apart position from the pilot mounting aperture;

inserting at least a portion of the inner end portion of the pilot into the pilot mounting aperture in the first face of the first die member;

forming a generally plate shaped window mount for operably retaining the pilot in the pilot mounting aperture in said one die member in an installed condition, and including:

forming at least one fastener aperture in a marginal portion of the window mount which extends laterally therethrough;

positioning at least one threaded fastener in the fastener aperture of the said window mount with the threaded shank portion thereof anchored in the fastener mounting aperture in the one die member to securely, yet detachably retain said window mount on the one die member;

forming a pilot mounting pocket in a central portion of the window mount for receiving said pilot, whereby the ejector pin automatically reciprocates between the retracted and extended positions relative to the pilot during operation of the metal forming die to insure that the stock strip is consistently stripped away from the outer end portion of the pilot.

32. A method for making a multi-station progressive metal forming die as set forth in claim 31, wherein:

said central portion of said window mount has an outer pocket portion oriented toward the stock strip and closely receiving therein said outer collar portion of said pilot in said installed condition, an inner pocket portion oriented away from the stock strip and closely receiving therein said inner collar portion of said pilot in said installed condition, and an annularly shaped, radially oriented support ledge disposed therebetween which abuttingly engages said shoulder on said pilot in said installed condition to securely locate said pilot in a precisely centered orientation condition in said pilot mounting aperture in said one die member.

33. A method for making a multi-station progressive metal forming die as set forth in claim 32, including:

a rigid generally hollow cylindrically shaped spacer operably positioned between said spring retainer rod on said inner end portion of said pilot and said spring member in said fully assembled pilot condition to retain said spring member in a concentric relationship with said inner end portion of said pilot and insure full contact between said outer end of said spring member and said inner end of said ejector pin.

34. A method for making a multi-station progressive metal forming die as set forth in claim 33, wherein:

said spring retainer rod on said inner end of said pilot includes a circumferentially extending retainer groove disposed adjacent said inner end surface of said spring retainer rod; and said retainer comprises a retainer ring received in said retainer groove which positively yet detachably retains said pilot, said ejector pin and said spring member in said fully assembled condition as a single assembly.

35. A method for making a multi-station progressive metal forming die as set forth in claim 34, wherein:

said pilot mounting aperture in said one die member includes a non-threaded outer bore portion oriented away from the stock strip with an inside diameter selected to loosely receive and retain therein said outer end portion of said pilot, said spring member and said retainer ring in said fully assembled and installed condition, a non-threaded inner bore portion oriented toward the stock strip with an inside diameter of the inner bore portion that is substantially the same as said first outside diameter of said first sidewall of said outer collar portion of said medial portion of said pilot to closely receive and retain the pilot therein, and an annularly shaped, radially oriented support surface therebetween which abuttingly engages said inner end surface of said inner end portion of said pilot, such that said outer collar portion of said medial portion of said pilot is positively captured between said support surface of said pilot mounting aperture in said one die member and said support ledge in said window mount.

36. A method for making a multi-station progressive metal forming die as set forth in claim 35, wherein:

said pilot has a one-piece construction formed from a solid bar of rigid material.

37. A method for making a multi-station progressive metal forming die as set forth in claim 36, wherein:

said medial portion of said pilot includes a plurality of said ejector pin apertures having equal diameters and arranged in a circumferentially spaced apart, mutually parallel, axially extending pattern through said medial portion to insure effective stripping of the stock strip from said outer end portion of said pilot; and including a plurality of said ejector pins having a substantially identical configuration and slidingly received and retained in said ejector pin apertures in said medial portion of said pilot.

38. A method for making a multi-station progressive metal forming die as set forth in claim 37, wherein:

said outer ends of said ejector pins selectively project from said ejector pin apertures in said medial portion of said pilot at locations immediately adjacent said innermost portion of said nose to insure effective stripping of the stock strip from said outer end portion of said pilot.

39. A method for making a multi-station progressive metal forming die as set forth in claim 38, wherein:

said outer ends of said ejector pins have a flat, generally circular plan shape to facilitate stripping the stock strip from said pilot; and said inner ends of said ejector pins have a flat, generally circular plan shape to facilitate abutting engagement with said outer end of said spring member.

40. A method for making a multi-station progressive metal forming die as set forth in claim 39, wherein:

said retainer ring comprises a split snap ring.

41. A method for making a multi-station progressive metal forming die as set forth in claim 40, wherein:

said medial portion of said pilot and said tapered nose of said pilot are arranged in a generally concentric relationship.

42. A method for making a multi-station progressive metal forming die as set forth in claim 41, wherein:

said outermost portion of said nose on said outer end portion of said pilot has a generally frustro-conical shape.

43. A method for making a multi-station progressive metal forming die as set forth in claim 42, wherein:

said pilot mounting pocket in said central portion of said window mount is non-threaded.

44. A method for making a multi-station progressive metal forming die as set forth in claim 43, wherein:

said one die member comprises a reciprocating die pad.

45. A method for making a multi-station progressive metal forming die as set forth in claim 44, wherein:

said fastener is a threaded bolt.

46. A modular stripper assembly for multi-station progressive metal forming dies having at least two mutually converging and diverging die members between which an elongate stock strip is shifted longitudinally to form parts from the stock strip, comprising:

a generally cylindrically shaped housing configured for operable support on one of the die members and having an outer end portion oriented toward the stock strip and an oppositely disposed inner end portion oriented away from the stock strip, wherein:

said outer end portion has an outer collar portion with an outer end surface oriented toward the stock strip and a generally cylindrical first sidewall with a first outside diameter, an inner collar portion with an inner end surface oriented away from the stock strip and a generally cylindrical second sidewall with a second outside diameter which is greater that said first outside diameter of said first sidewall of said outer collar portion and defines an annularly shaped, radially oriented shoulder therebetween for securing said housing in an associated mounting aperture in the one die member, and at least one axially oriented ejector pin aperture which extends through said outer end surface and opens generally to said inner end surface;

said inner end portion has a generally cylindrically shaped spring retainer rod protruding inwardly from said inner end surface of said inner collar portion, with an inner end portion of the spring retainer rod oriented away from the stock strip and an outer sidewall with an outside diameter that is less than said second outside diameter of said second sidewall of said inner collar portion;

a spring member having a generally hollow interior that is received onto and over said spring retainer rod, an outer end oriented toward the stock strip, and an opposite inner end oriented away from the stock strip and positioned adjacent to said inner end surface of said spring retainer rod;

at least one rigid ejector pin slidingly received and retained in said ejector pin aperture in said medial portion of said housing, the rigid ejector pin having an outer end that protrudes outwardly from said outer end surface of said outer collar portion of said medial portion when urged to an extended condition to contact the stock strip and strip the stock strip away from said die member, and retracts toward said outer end portion of said housing when urged to a retracted position, and an inner end that operably engages said outer end of said spring member and is thereby biased outwardly by said spring member toward said extended condition;

a retainer operably connecting said inner end portion of said spring retainer rod with said inner end of said spring member in a pre-tensed condition to define a fully assembled condition wherein said ejector pin is biased toward said extended condition; and a generally plate shaped window mount for operably supporting said housing in said fully assembled condition in the mounting aperture in the one die member to define an installed condition, and having:

a marginal portion with at least one fastener aperture extending laterally therethrough;

at least one fastener positioned in said fastener aperture of said window mount and having a threaded shank portion configured for anchoring in the one die member to securely, yet detachably retain said window mount on the one die member;

a central portion with a through mounting aperture for receiving the housing, whereby said ejector pin automatically reciprocates between said retracted and extended positions relative to said housing during operation of the metal forming die to insure that the stock strip is consistently stripped away from said die member.

47. A modular stripper assembly as set forth in claim 46, wherein:

said central portion of said window mount has an outer pocket portion oriented toward the stock strip and closely receiving therein said outer collar portion of said housing in said installed condition, an inner pocket portion oriented away from the stock strip and closely receiving therein said inner collar portion of said housing in said installed condition, and an annularly shaped, radially oriented support ledge disposed therebetween which abuttingly engages said shoulder on said housing in said installed condition to securely locate said housing in a precisely centered orientation condition in said mounting aperture in said one die member.

48. A modular stripper assembly as set forth in claim 47, including:

a rigid generally hollow cylindrically shaped spacer operably positioned between said spring retainer rod on said inner end portion of said housing and said spring member in said fully assembled pilot condition to retain said spring member in a concentric relationship with said inner end portion of said housing and insure full contact between said outer end of said spring member and said inner end of said ejector pin.

49. A modular stripper assembly as set forth in claim 48, wherein:

said spring retainer rod on said inner end of said housing includes a circumferentially extending retainer groove disposed adjacent said inner end surface of said spring retainer rod; and said retainer comprises a retainer ring received in said retainer groove which positively yet detachably retains said housing, said ejector pin and said spring member in said fully assembled condition as a single assembly.

50. A modular stripper assembly as set forth in claim 49, wherein:

said mounting aperture in said one die member includes a non-threaded outer bore portion oriented away from the stock strip with an inside diameter selected to loosely receive and retain therein said outer end portion of said housing, said spring member and said retainer ring in said fully assembled and installed condition, a non-threaded inner bore portion oriented toward the stock strip with an inside diameter of the inner bore portion that is substantially the same as said first outside diameter of said first sidewall of said outer collar portion of said outer end portion of said housing to closely receive and retain the housing therein, and an annularly shaped, radially oriented support surface therebetween which abuttingly engages said inner end surface of said inner end portion of said housing, such that said outer collar portion of said outer end portion of said housing is positively captured between said support surface of said mounting aperture in said one die member and said support ledge in said window mount.

51. A modular stripper assembly as set forth in claim 50, wherein:

said housing has a one-piece construction formed from a solid bar of rigid material.

52. A modular stripper assembly as set forth in claim 51, wherein:

said outer end portion of said housing includes a plurality of said ejector pin apertures having equal diameters and arranged in a circumferentially spaced apart, mutually parallel, axially extending pattern through said outer end portion to insure effective stripping of the stock strip from said die member; and including a plurality of said ejector pins having a substantially identical configuration and slidingly received and retained in said ejector pin apertures in said outer end portion of said housing.

53. A modular stripper assembly as set forth in claim 52, wherein:

said outer ends of said ejector pins selectively project from said ejector pin apertures in said medial portion of said pilot at locations immediately adjacent said innermost portion of said nose to insure effective stripping of the stock strip from said outer end portion of said pilot.

54. A modular stripper assembly as set forth in claim 53, wherein:

said outer ends of said ejector pins have a flat, generally circular plan shape to facilitate stripping the stock strip from said die member; and said inner ends of said ejector pins have a flat, generally circular plan shape to facilitate abutting engagement with said outer end of said spring member.

55. A modular stripper assembly as set forth in claim 54, wherein:

said retainer ring comprises a split snap ring.

56. A modular stripper assembly as set forth in claim 55, wherein:

said through mounting aperture in said central portion of said window mount is non-threaded.

57. A modular stripper assembly as set forth in claim 56, wherein:

said one die member comprises a reciprocating die pad.

58. A modular stripper assembly as set forth in claim 57, wherein:

said fastener is a threaded bolt.

59. A modular stripper assembly as set forth in claim 58, wherein:

multiple fasteners and dowels are used to locate and secure said window mount to said die member.

* * * * *